US011193267B2

(12) United States Patent
Rimoli

(10) Patent No.: US 11,193,267 B2
(45) Date of Patent: Dec. 7, 2021

(54) TENSEGRITY STRUCTURES AND METHODS OF CONSTRUCTING TENSEGRITY STRUCTURES

(71) Applicant: Georgia Tech Research Corporation, Atlanta, GA (US)

(72) Inventor: Julian Jose Rimoli, Atlanta, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 167 days.

(21) Appl. No.: 16/339,864

(22) PCT Filed: Oct. 10, 2017

(86) PCT No.: PCT/US2017/055988
§ 371 (c)(1),
(2) Date: Apr. 5, 2019

(87) PCT Pub. No.: WO2018/068056
PCT Pub. Date: Apr. 12, 2018

(65) Prior Publication Data

US 2019/0242110 A1 Aug. 8, 2019

Related U.S. Application Data

(60) Provisional application No. 62/405,371, filed on Oct. 7, 2016.

(51) Int. Cl.
*E04B 1/19* (2006.01)
*E04B 1/58* (2006.01)

(52) U.S. Cl.
CPC ..... *E04B 1/1903* (2013.01); *E04B 1/19* (2013.01); *E04B 1/58* (2013.01); *E04B 2001/1978* (2013.01); *E04B 2001/1981* (2013.01); *E04B 2001/1984* (2013.01); *E04B 2001/1996* (2013.01)

(58) Field of Classification Search
None
See application file for complete search history.

(56) References Cited

U.S. PATENT DOCUMENTS 3,695,617 A * 10/1972 Mogilner ..... A63F 9/088 273/156
5,505,035 A * 4/1996 Lalvani ..... E04B 1/19 52/648.1
6,901,714 B2 * 6/2005 Liapi ..... E04B 1/19 343/915
7,694,463 B2 * 4/2010 Lanahan ..... E04B 1/19 52/81.1
8,402,711 B2 * 3/2013 Lusk ..... B25J 9/08 52/646
10,624,455 B2 * 4/2020 Schiraga ..... A47C 7/008
(Continued)

*Primary Examiner* — Brian E Glessner
*Assistant Examiner* — Adam G Barlow
(74) *Attorney, Agent, or Firm* — Troutman Pepper Hamilton Sanders LLP; Ryan A. Schneider

(57) ABSTRACT

Tensegrity structures and methods of constructing tensegrity structures of three-dimensional tensegrity lattices formed from truncated octahedron elementary cells. Space-tiling translational symmetry is achieved by performing recursive reflection operations on the elementary cells. This topology exhibiting unprecedented static and dynamic mechanical properties.

22 Claims, 24 Drawing Sheets

(56) References Cited

U.S. PATENT DOCUMENTS

| | | | | |
|---|---|---|---|---|
| 2006/0027071 | A1* | 2/2006 | Barnett | G10D 13/08 84/402 |
| 2006/0160446 | A1* | 7/2006 | Lanahan | E04B 1/19 442/59 |
| 2008/0040984 | A1* | 2/2008 | Lanahan | E02B 3/04 52/79.9 |
| 2019/0023358 | A1* | 1/2019 | Nandigama | B63B 1/107 |
| 2019/0234089 | A1* | 8/2019 | Jamin | E04H 3/126 |
| 2019/0382995 | A1* | 12/2019 | Chen | E04B 1/19 |

* cited by examiner (A) (B)

TENSEGRITY STRUCTURES AND METHODS OF CONSTRUCTING TENSEGRITY STRUCTURES

CROSS-REFERENCE TO RELATED APPLICATIONS

This application claims the benefit of U.S. Provisional Application No. 62/405,371 filed 7 Oct. 2016 the entire contents and substance of which is hereby incorporated by reference.

BACKGROUND OF THE INVENTION

1. Field of the Invention

The present invention relates generally to tensegrity structures and methods of constructing tensegrity structures, and more specifically to three-dimensional tensegrity lattices forming structures and methods of constructing three-dimensional tensegrity lattices forming structures.

2. Description of Related Art

The term tensegrity, a portmanteau of tensional integrity, refers to a certain class of structural systems composed of compression members (bars or struts) and tensional members (strings or cables). The term was coined by Buckminster Fuller in the 1960s to describe a structural principle based on the use of isolated components in compression inside a net of continuous tension, in such a way that the compression members do not touch each other and the prestressed tensional members delineate the system spatially.

Through adequate pre-stressing of their cable members, tensegrity structures generally become mechanically stable, meaning that their load-bearing capability remains intact even after undergoing severe deformation. Fuller defined a tensegrity system as a structure that "will have the aspect of continuous tension throughout and the compression will be subjugated so that the compression elements become small islands in a sea of tension." This definition was later formalized by Pugh as follows: "A tensegrity system is established when a set of discontinuous compression components interacts with a set of continuous tensile components to define a stable volume in space." Pugh Anthony. An introduction to tensegrity. Univ. of California Press; 1976. It is precisely the isolation of compression members that renders tensegrity structures particularly well suited for impact absorption applications.

Most available techniques for the design of tensegrity structures can be grouped into two categories. On the one hand, methods that rely on the systematic application of topological and geometric (architectural) rules to regular polyhedrons have been applied to the generation of tensegrity elementary cells.

On the other hand, efforts have been made to either combine elementary cells or apply rules of self-similarity to generate complex structures of engineering interest, for example, columns, beams, and plates. In addition to these traditional approaches, recent research efforts have focused on the design of tensegrity structures via optimization techniques.

Despite continuous advances in the field over the past few decades, the design of three-dimensional tensegrity lattices has remained an elusive goal. The generation of a Bravais lattice requires that, upon translation by a linear combination of the Bravais vectors, the unit cell of the lattice seamlessly matches the neighboring cells. The low symmetries of elementary tensegrity cells (usually due to torsion components) makes this task very difficult to achieve, even for the two-dimensional case. In the case of one-dimensional lattices, torsion is not an issue as its only effect is to generate a twist along the axis of the lattice. Furthermore, when considering one-dimensional lattices composed of three-bar elementary cells, this twist can be mitigated by alternating cells with clockwise and counter-clockwise torsion. However, this kind of lattice fails to comply with the most rigorous definition of tensegrity as three continuum paths of compression members are generated along the entire length of the lattice.

The conventional state-of-the-art in tensegrity lattices are limited to one-dimensional lattices. FIGS. 1-3. Even in this case, lattices are not "tensegrity" in the sense that compression members form continuum paths that begin and end at the extremes of the lattice.

The mechanical properties of cellular materials are defined by the constituent material properties and the architecture (topology and geometry). Advances over the last decade focused on the material properties by exploiting material size-effects. Little attention has been placed on architecture. It would be beneficial to develop an inventive type of architecture that leads to improved mechanical response for energy absorption applications, among others. This architecture is an object of the present invention.

Unlike trusses, tensegrity structures can be designed to operate in the post-buckling regime. Post-buckling behavior of bars allows for a significant increase in the stored elastic strain energy when comparing to the impending-buckling condition. Post-buckling behavior also acts as a load-limiting mechanism in tensegrity structures, producing evenly loaded structures. It would also be beneficial if these concepts could be extended to the design of tensegrity-based three-dimensional metamaterials for energy absorption. This architecture is another object of the present invention.

SUMMARY OF THE INVENTION

Perhaps due to the lack of adequate symmetries on traditional tensegrity elementary cells, the design of three-dimensional tensegrity lattices has remained an elusive goal. The present invention includes methods to construct three-dimensional tensegrity lattices from truncated octahedron elementary cells. The required space-tiling translational symmetry is achieved by performing recursive reflection operations on the elementary cells.

Mechanical responses of the resulting lattices are analyzed in the fully nonlinear regime via two distinctive approaches: adopting a discrete reduced-order model that explicitly accounts for the deformation of individual tensegrity members, and then utilizing this model as the basis for the development of a continuum approximation for the tensegrity lattices, with an objective of efficiently modeling the constitutive behavior of tensegrity meta-materials.

Using this homogenization method, tensegrity lattices are studied under a wide range of loading conditions and prestressed configurations. Ashby charts for yield strength to density ratio illustrate how the present tensegrity lattices can potentially achieve superior performance when compared to other lattices available in the literature.

Finally, numerical results on the behavior of a single tensegrity unit cell under a wide range of loading conditions are presented and the effective properties are compared with existing natural and artificial materials. Additionally, using the discrete model, the dynamic response of a finite tensegrity lattice impacting an elastic wall is analyzed, where a strong asymmetry in the dispersion of tensile and compressive stress-waves propagating through the medium is observed.

Conventional tensegrity elementary cells lack translational symmetries—they cannot be simply stacked to build a three-dimensional lattice. Even if stacking were possible, the nature of their topology would generate undesired continuum compression paths the overall structure becomes unstable after individual bar buckling. Both issues are addressed by the present invention, applying successive reflection operations to an elementary cell to build an eight-cell lattice unit that has translational symmetries, and discontinuous compression loops provide post-buckling stability. These eight-cell units can be stacked to form lattices of arbitrary dimensions.

As used herein, the inventive "three-dimensional" tensegrity lattices of the present invention are new in the art. Reference to systems as one-, two-, and three-dimensional tensegrity units are based on their ability to tessellate a line, a plane, and the space, respectively.

Thus, the starting elementary cell of the present invention is the tensegrity unit based on a truncated octahedron. As used herein, this elementary cell is "zero-dimensional," as it does not have any translational symmetry. After the first reflection operation, a two-cell system is obtained that has translational symmetry in the direction normal to the reflection plane. Because of this translational symmetry in only one direction, as used herein, this system is "one-dimensional." This constitutes a basic building block for tensegrity beams.

In the present invention, a second reflection operation is subsequently performed, achieving a second translational symmetry. Because of the two translational symmetries, as used herein, this system is "two-dimensional." This four-cell system constitutes a basic building block for tensegrity plates.

In the present invention, a last reflection operation is subsequently performed obtaining an eight-cell system with three translational symmetries. Thus, the resulting system is inherently "three-dimensional," constituting the basic building block for the present tensegrity lattices.

Unlike trusses, the present tensegrity structures can be designed to operate in the post-buckling regime. Post-buckling behavior of bars allows for a significant increase in the stored elastic strain energy when comparing to the impending-buckling condition. Post-buckling behavior also acts as a load-limiting mechanism in tensegrity structures, producing evenly loaded structures. These concepts are applied to the design of tensegrity-based three-dimensional metamaterials for energy absorption. Three-dimensional tensegrity metamaterials have not existed before, representing a radical departure from traditional lattices (and even previous works on tensegrity structures). In this case, high specific strength can be achieved without compromising recoverability. Tensegrity metamaterials' asymmetric wave propagation, dispersive nature, and ability to change phases have applications in vibration energy transfer and impact absorption.

In an exemplary embodiment, the present invention is a structure comprising a three-dimensional tensegrity lattice.

The three-dimensional tensegrity lattice can comprise compression members (bars) and tensional members (cables), wherein compression members and tensional members are communicative at nodes, each node having at least one compression member-to-tensional member connection.

At least portion of the compression members either form a closed compression member loop forming a discontinuous compression path, or form a two-compression member V-shape arrangement at a node, or are isolated from other compression members via nodes without an additional compression member.

Preferably, each of the compression members either form a closed compression member loop forming a discontinuous compression path, or form a two-compression member V-shape arrangement at a node, or are isolated from other compression members via nodes without an additional compression member The closed compression member loop provides post-buckling stability to the structure.

The structure is globally stable after failure by buckling of individual compression members.

In another exemplary embodiment, the present invention is a structure comprising a three-dimensional tensegrity lattice formed from a plurality of truncated octahedron elementary cells.

Each truncated octahedron elementary cell can comprise compression members and tensional members, wherein compression members and tensional members are communicative at nodes, each node having at least one compression member-to-tensional member connection.

The structure can comprise eight truncated octahedron elementary cells.

The eight truncated octahedron elementary cells preferably form an elementary building block for the tensegrity lattice and formed through three reflection operations.

A first reflection operation can start with a first zero-dimensional truncated octahedron elementary cell having no translational symmetry and obtaining a one-dimensional two-cell system that has a first translational symmetry in the direction normal to a reflection plane.

A second reflection operation can start with the one-dimensional two-cell system and obtaining a two-dimensional four-cell system that has the first translational symmetry and a second translational symmetry.

A third reflection operation can start with the two-dimensional four-cell system and obtaining a three-dimensional eight-cell system that has the first translational symmetry, the second translational symmetry, and a third translational symmetry.

The structure formed from the three reflection operations can comprising a plurality of elementary building blocks, wherein each compression member of an elementary building block either forms a closed compression member loop forming a discontinuous compression path, or forms a two-compression member V-shape arrangement at a node, or is isolated from other compression members via nodes without an additional compression member.

The structure formed from the three reflection operations is globally stable after failure by buckling of individual compression members.

In another exemplary embodiment, the present invention is a structure comprising a three-dimensional tensegrity lattice formed from a plurality of truncated octahedron elementary cells, wherein each truncated octahedron elementary cell comprises six square faces that are parallel in pairs.

The planes containing each parallel pair preferably are perpendicular to those corresponding to the other two pairs.

Each face of a truncated octahedron elementary cell can be defined by four nodes.

A group of four contiguous truncated octahedron elementary cells can have coincident nodes.

Each truncated octahedron elementary cell can comprise compression members and tensional members, wherein compression members and tensional members are communicative at nodes, each node having at least one compression member-to-tensional member connection.

The structure preferably comprises eight truncated octahedron elementary cells.

The eight truncated octahedron elementary cells preferably form an elementary building block for the tensegrity lattice and formed through three reflection operations, a first reflection operation starting with a first zero-dimensional truncated octahedron elementary cell having no translational symmetry and obtaining a one-dimensional two-cell system that has a first translational symmetry in the direction normal to a reflection plane, a second reflection operation starting with the one-dimensional two-cell system and obtaining a two-dimensional four-cell system that has the first translational symmetry and a second translational symmetry, and a third reflection operation starting with the two-dimensional four-cell system and obtaining a three-dimensional eight-cell system that has the first translational symmetry, the second translational symmetry, and a third translational symmetry.

The structure preferably comprises a plurality of elementary building blocks, wherein each compression member of an elementary building block either forms a closed compression member loop forming a discontinuous compression path, or forms a two-compression member V-shape arrangement at a node, or is isolated from other compression members via nodes without an additional compression member.

In another exemplary embodiment, the present invention is a three-dimensional tensegrity lattice formed from a plurality of truncated octahedron elementary cells, wherein each truncated octahedron elementary cell comprises compression elements and tensional elements, wherein at least a portion of the tensional elements are pre-stressed while providing a stable structure.

In another exemplary embodiment, the present invention is a structure comprising a three-dimensional tensegrity lattice formed from a plurality of truncated octahedron elementary cells, wherein each truncated octahedron elementary cell comprises compression members having the same compression member characteristic and tensional members having the same tensional member characteristic, wherein compression members and tensional members are communicative at nodes, each node having at least one compression member-to-tensional member connection.

The compression member characteristic can be selected from the group consisting of a variety of observations, like the material composition of a compression member (bar), bar length, bar shape, bar elasticity, bar conductivity. Bars can be solid forms or hollow, can be annular or have alternative cross-sections. The cross-section can be uniform along the length of a bar, or be non-uniform. Not all bars of a structure need have the same characteristic of other bars of the structure.

The tensional member characteristic can be selected from the group consisting of a variety of observations, like the material composition of a tensional member (cable), cable length, cable shape, cable elasticity, cable conductivity. Cables can be solid forms or hollow, can be annular or have alternative cross-sections. The cross-section can be uniform along the length of a cable, or be non-uniform. Not all cables of a structure need have the same characteristic of other cables of the structure.

When referring to the structure's topology and geometry, the compression member characteristic can be the same type as the tensional member characteristic. The compression member characteristic can be the same as the tensional member characteristic. The compression member characteristic can be different from the tensional member characteristic.

For example only and not intending to be limited to any particular "characteristic"—some or all of the bars can be formed of one material composition, while some or all of the cables are formed from another material composition different from the bar material composition.

Alternatively, some or all of the bars and cables can be formed from the same material composition.

Or the conductivity of some or all of the bars can be different from the conductivity of other of the bars, of some cables, or all cables. Or the conductivity of some or all of the cables can be different from the conductivity of other of the cables, of some bars, or all bars. Or all bars and cables can have the same conductivity.

Or some or all of the bars can be pre-stressed or pre-strained by different amounts or the same amount, and some or all of the cables can be pre-stressed or pre-strained by different amounts or the same amount.

Or the lengths of some bars can be different from other bars, or different from some or all of the cables. Similarly, the lengths of some cables can be different from other cables, or different from some or all of the bars.

In another exemplary embodiment, the present invention presents unique mechanical capabilities when compared to traditional truss lattices, namely body-centered cubic (BCC) and face-centered cubic (FCC) lattices, assuming each of the lattices of same total mass density. For example, when a traditional truss lattice having the same total mass density as the present invention was examined during simulations of damage evolution in the form of buckled bars, the traditional truss lattice become globally unstable at relatively low strain (on the order of $1\times10^{-3}$), and most importantly their failure regions are localized.

The tensegrity lattice of the present invention, having the same total mass density as that of the previously tested traditional truss lattice is able to withstand a significantly larger deformation without exhibiting global failure, even after multiple bar members have buckled. The simulations were arbitrarily stopped at a strain of 0.75 without seeing a global instability. This is a consequence of failure not localizing to specific regions in the lattice.

Thus, the present invention can comprise a globally stable structure comprising a three-dimensional tensegrity lattice having a total mass density, wherein when a traditional truss lattice having the same total mass density as the three-dimensional tensegrity lattice is subjected to a failure strain defined as the strain deforming the traditional truss lattice to the point where it becomes globally unstable, the three-dimensional tensegrity lattice can be subjected to a strain over 100 times the amount of the failure strain of the traditional truss lattice, yet remain globally stable. Indeed, it can withstand a strain over 500 times, and up to 750 times in a specific instance.

Similarly, the stress strain behavior of all three lattices was investigated. The traditional truss lattices, being stiffer, withstand a larger maximum stress than the present tensegrity lattice. However, they fail rapidly due to the aforementioned instability. The present tensegrity lattice is more compliant and able to take a very large deformation. Consequently, the total strain energy density of the present tensegrity lattice is much larger than that corresponding to the BCC and FCC truss lattices. In one specific instance, the amplification is a factor of 50 for the BCC lattice and over 100 for the FCC one.

Thus, the present invention can comprise a globally stable structure comprising a three-dimensional tensegrity lattice having a total mass density, wherein when a traditional truss lattice having the same total mass density as the three-dimensional tensegrity lattice is subjected to a load to evaluate stress strain behavior, the total strain energy density of the three-dimensional tensegrity lattice is greater than the total strain energy density of the traditional truss lattice. Indeed, it can withstand a factor of 50 to a factor of 100 times greater than the total strain energy density of the traditional truss lattice.

In another exemplary embodiment, the present invention is a process of forming a three-dimensional tensegrity lattice comprising providing a plurality of elementary cells and performing recursive reflection operations on the elementary cells, wherein space-tiling translational symmetry is achieved.

The resulting three-dimensional tensegrity lattice can comprise compression members and tensional members, wherein compression members and tensional members are communicative at nodes, each node having at least one compression member-to-tensional member connection, and wherein at least portion of the compression members either form a closed compression member loop forming a discontinuous compression path, or form a two-compression member V-shape arrangement at a node, or are isolated from other compression members via nodes without an additional compression member.

Any of the inventive three-dimensional tensegrity lattice can be useful in a number of applications, including helmets (of any kind, including those for sports and military applications), bumpers, crash-resistant structures, and planetary landers as examples. When compared to conventional lattices, the present tensegrity structures can undergo severe deformation without permanent deformation, which makes them good candidates for impact and energy absorption applications.

Additional applications for the present invention include, for example, armor applications to more generic crash worthiness problems such as those experienced by planetary landers, or even regular vehicles during accidents. The present technology provides high energy absorption while making possible to recover the geometry after the crash/impact event occurred.

In another exemplary embodiment, the present invention is a process of forming a three-dimensional tensegrity lattice comprising providing a first zero-dimensional truncated octahedron elementary cell having no translational symmetry and performing recursive reflection operations on the truncated octahedron elementary cell until a three-dimensional eight-cell system that has three translational symmetries is formed.

In the process space-tiling translational symmetry preferably is achieved.

In another exemplary embodiment, the present invention is a process of forming a three-dimensional tensegrity lattice comprising providing a zero-dimensional truncated octahedron elementary cell having no translational symmetry, performing a first reflection on the zero-dimensional truncated octahedron elementary cell having no translational symmetry and obtaining a one-dimensional two-cell system that has a first translational symmetry in the direction normal to a reflection plane, performing a second reflection operation on the one-dimensional two-cell system and obtaining a two-dimensional four-cell system that has the first translational symmetry and a second translational symmetry, and performing a third reflection operation on the two-dimensional four-cell system and obtaining a three-dimensional eight-cell system that has the first translational symmetry, the second translational symmetry, and a third translational symmetry.

These and other objects, features and advantages of the present invention will become more apparent upon reading the following specification in conjunction with the accompanying drawing figures.

BRIEF DESCRIPTION OF THE DRAWINGS

FIG. 10 is replaced by the discrete system shown in FIG. 11.

FIG. 14 is an isometric view and FIG. 15 a side view showing the cables under tension (thin lines) and the bars under compression (thick—highlighted).

FIG. 17 is an isometric view and FIG. 18 a top view showing the bars under both tension (thick—highlighted) and compression (thick). Most of the cables remain under tension (thin lines—highlighted), while some remain stress-free (thin lines).

FIG. 19 shows tensile (dashed curves) and compressive (solid curves) yield strengths for both uniaxial strain (filled markers) and uniaxial stress (hollow markers) conditions. FIG. 20 shows comparison of tensile yield strength under uniaxial strain loading with brittle and ductile ceramic nanolattices.

In FIG. 25 one can see the damage evolution on the BCC and FCC lattices in the form of buckled bars.

FIG. 26 shows the same quantity illustrated in FIG. 25 for BCC and FCC lattices, for an exemplary embodiment of the present invention.

FIG. 27 shows the stress strain behavior of all three lattices—BCC, FCC and the present invention.

DETAIL DESCRIPTION OF THE INVENTION

Figure 1:
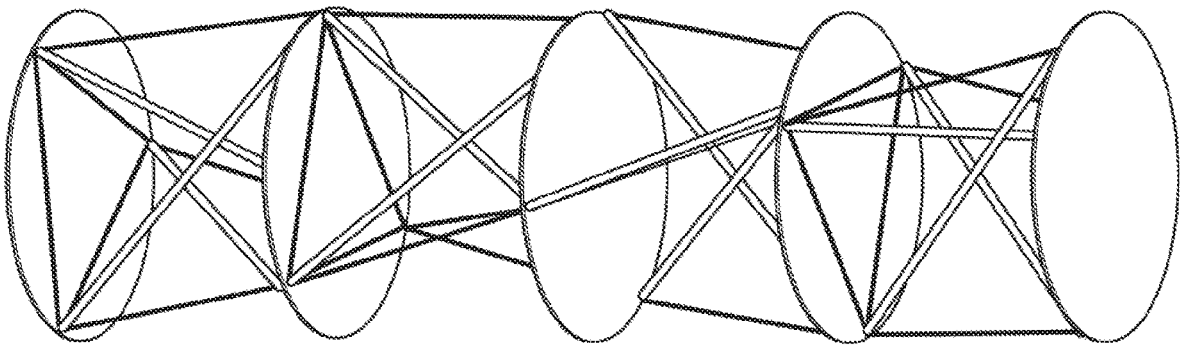
FIGS. 1-3 illustrate the current state of the art in investigating tensegrity via one-dimensional lattices. One-dimensional lattices can be considered columns, where two-dimensional lattices would be plates.
Figure 2:
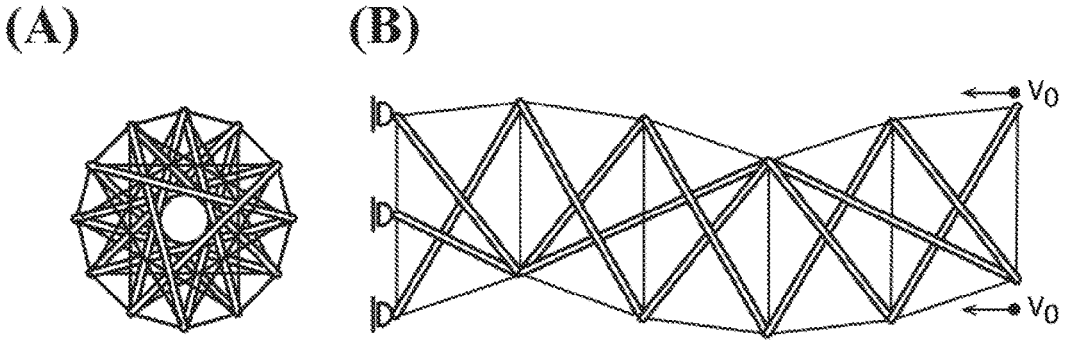
Figure 3:
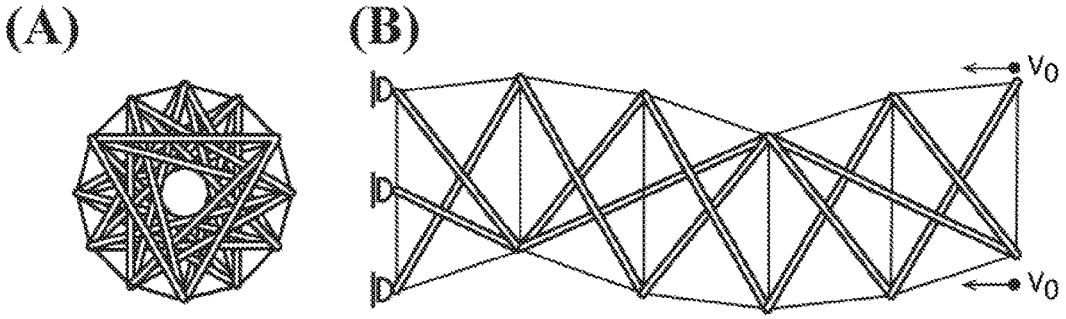

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways.

As used in the specification and the appended Claims, the singular forms "a," "an" and "the" include plural references unless the context clearly dictates otherwise. For example, reference to a component is intended also to include a composition of a plurality of components. References to a composition containing "a" constituent is intended to include other constituents in addition to the one named.

In describing exemplary embodiments, terminology will be resorted to for the sake of clarity. It is intended that each term contemplates its broadest meaning as understood by those skilled in the art and includes all technical equivalents that operate in a similar manner to accomplish a similar purpose.

Ranges may be expressed as from "about" or "approximately" or "substantially" one value and/or to "about" or "approximately" or "substantially" another value. When such a range is expressed, other exemplary embodiments include from the one value and/or to the other value.

Similarly, as used herein, "substantially free" of something, or "substantially pure", and like characterizations, can include both being "at least substantially free" of something, or "at least substantially pure", and being "completely free" of something, or "completely pure".

"Comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

The characteristics described as defining the various elements of the invention are intended to be illustrative and not restrictive. For example, if the characteristic is a material, the material includes many suitable materials that would perform the same or a similar function as the material(s) described herein are intended to be embraced within the scope of the invention. Such other materials not described herein can include, but are not limited to, for example, materials that are developed after the time of the development of the invention.

A Three-Dimensional Tensegrity Lattice

Figure 4:
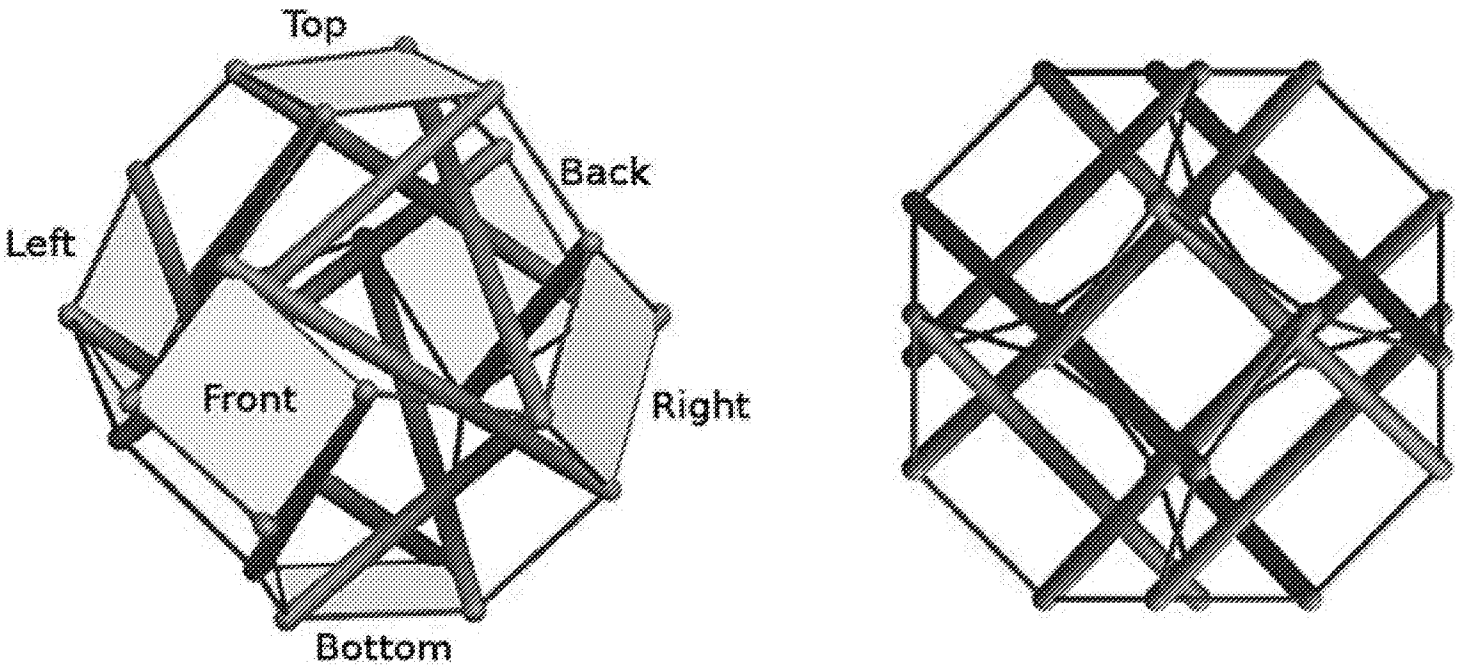
FIG. 4 illustrates the building elementary cell for lattice. Perspective (FIG. 4A) and top (FIG. 4B) views with legends indicating naming convention.

Consider a tensegrity elementary cell obtained from a truncated octahedron shown in FIG. 4. The cell contains six square faces, which are parallel in pairs, with the planes containing each pair being perpendicular to those corresponding to the other two pairs. (FIG. 4A) As used herein, they include squares: top, bottom, left, right, back, and front. That is, the top square is parallel to the bottom square, and perpendicular to all others. The same applies to the left-right and front-back pairs.

At first sight, it might seem that because all squares are placed on the faces of a containing cube, this elementary cell could tile $\mathbb{R}^3$, thus generating a three-dimensional lattice. However, the squares corresponding to each pair have opposite twists with respect to the normal to the plane and they do not coincide when projected on the plane parallel to the faces of the two squares (FIG. 4B). Thus, if one were to simply translate the elementary cell, they would end up with an incompatible configuration, as the nodes of the adjacent squares would not overlap.

Figure 5:
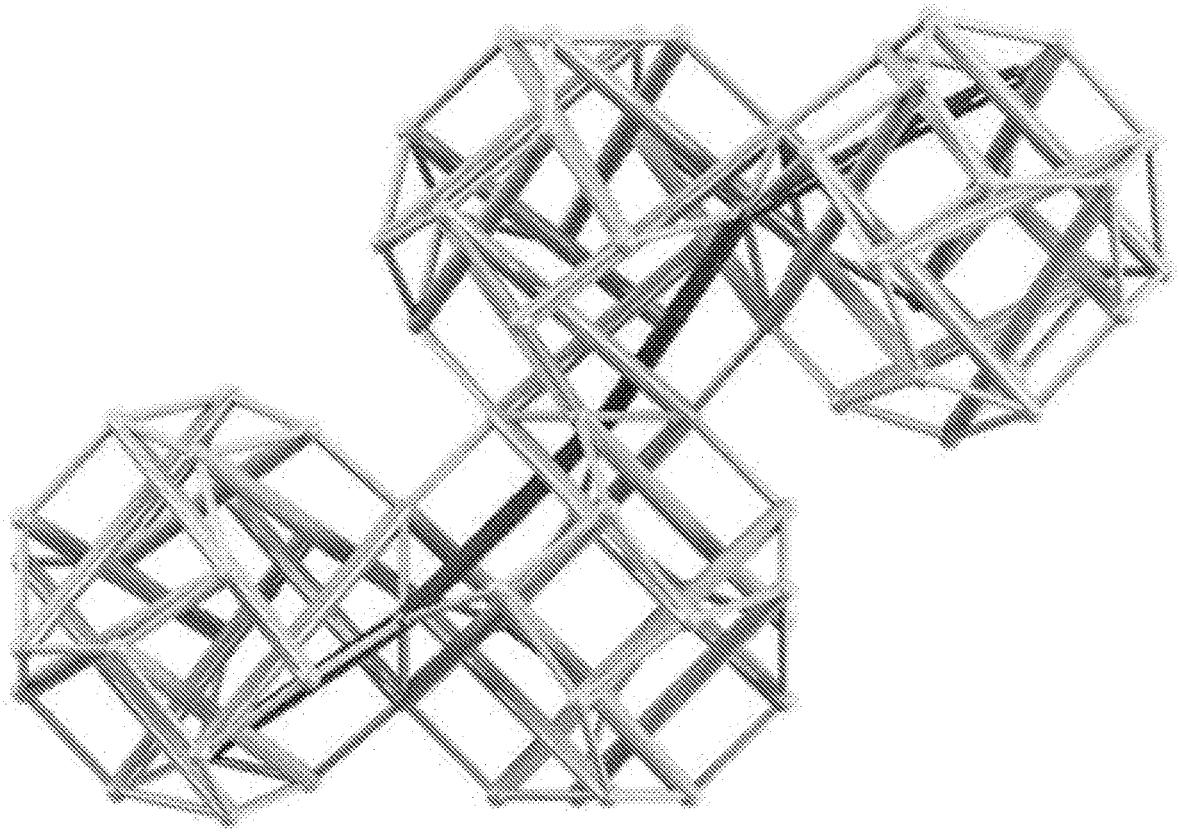
FIG. 5 illustrates that simply stacking elementary cells leads to continuum compression paths extending throughout the structure.

This incompatibility is illustrated in FIG. 5. Consider the bottom-right elementary cell. As shown, its main axes are aligned with the perspective of the reader in such a way that the top, bottom, left, and right planes remain perpendicular to the viewing plane, whereas the front and back squares are parallel to it. Even though the elementary cell stacked to its left maintains the alignment of the left and right planes, all other planes are rotated with respect to the normal to the coincident face between the cells.

The same effect is observed on the elementary cell stacked to the top, with only the top and bottom planes remaining in place. This effect gets worse as one keeps stacking cells next to each other. For example, FIG. 5 shows that the top-right elementary cell has lost all the alignments with respect to the original cell. Furthermore, due to this misalignment, it would be impossible to insert an elementary cell to connect the bottom-right and top-right cells.

Additionally, even if somehow one could remove the torsion of the elementary cell, e.g. by selecting cables and bars of varying lengths, another problem remains: for such a configuration, bars would generate continuum compression paths that always initiate an external surface of the lattice, then propagate through its interior to finally terminate at another external boundary of the structure. This kind of lattice fails to comply with the most rigorous definition of tensegrity, as there would not be isolated compression islands within the structure. This, in turn, could negatively affect the stability of the lattice once buckling starts to develop on one of those paths. A continuum compression path is highlighted in FIG. 5 for purpose of illustration.

To address these issues, namely the incompatibility between cells and the presence of continuum compression paths within the structure, the present invention is the construction of a lattice from a macro unit cell comprising eight elementary cells related to each other through consecutive reflection operations.

Figure 6:
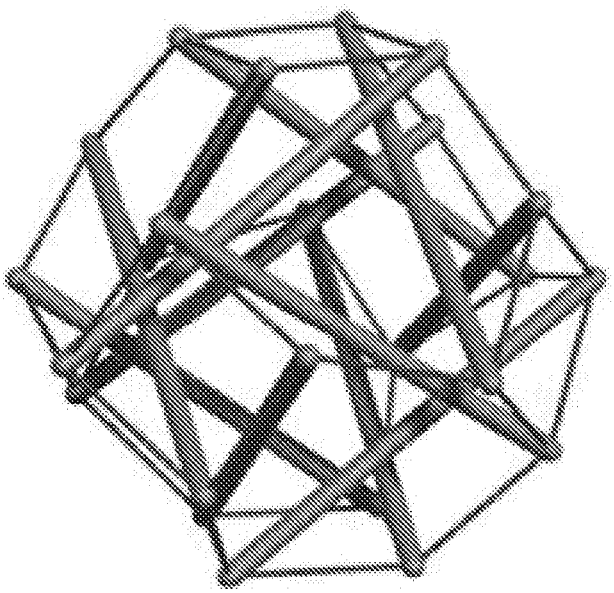
FIGS. 6-9 illustrate the sequence of reflection operations needed to generate a unit cell compatible with translational symmetries according to an exemplary embodiment of the present invention.
Figure 7:
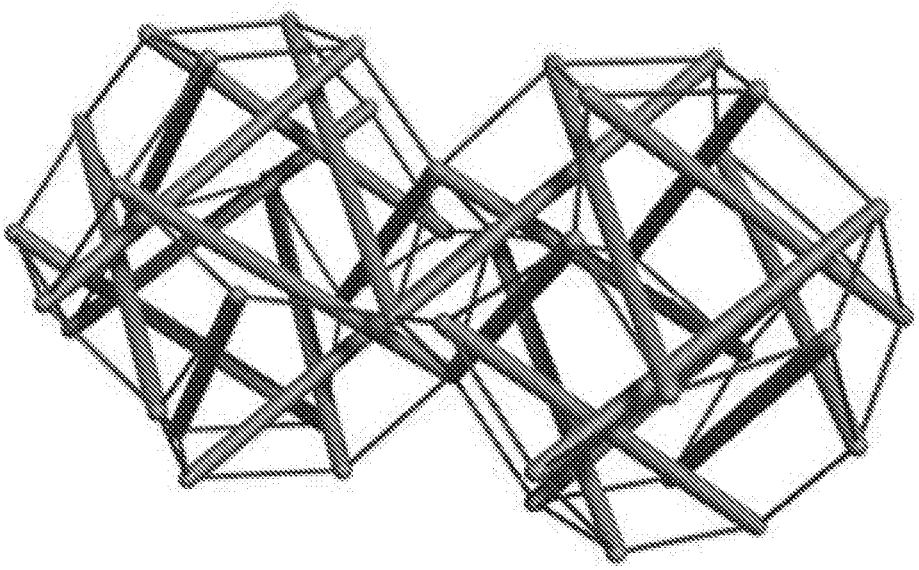

In an exemplary embodiment of the invention, initially a reflection of the elementary cell (FIG. 6) is performed with respect to the plane containing its right face, obtaining a system of two cells (FIG. 7). The left and right faces of this two-cell unit now have coincident nodes due to the reflection operation. Consequently, this system can be considered as a building block for one-dimensional tensegrity lattices, or in structural terms, tensegrity columns. It is worth emphasizing that, as a result of this operation, the top, bottom, front, and back squares of the resulting elementary cells remain aligned to those of the original one.

Subsequently, the present invention reflects this two-cell system with respect to the plane containing their top faces, resulting in the four-cell configuration depicted in FIG. 8. By construction, the left, right, top, and bottom squares of the resulting four-cell unit have coincident nodes. Consequently, this system can be considered as a building block for two-dimensional tensegrity lattices, or in structural terms, tensegrity plates. As in the previous step, all squares remain in their original planes, confined to the faces of a rectangular parallelepiped.

Figure 9:
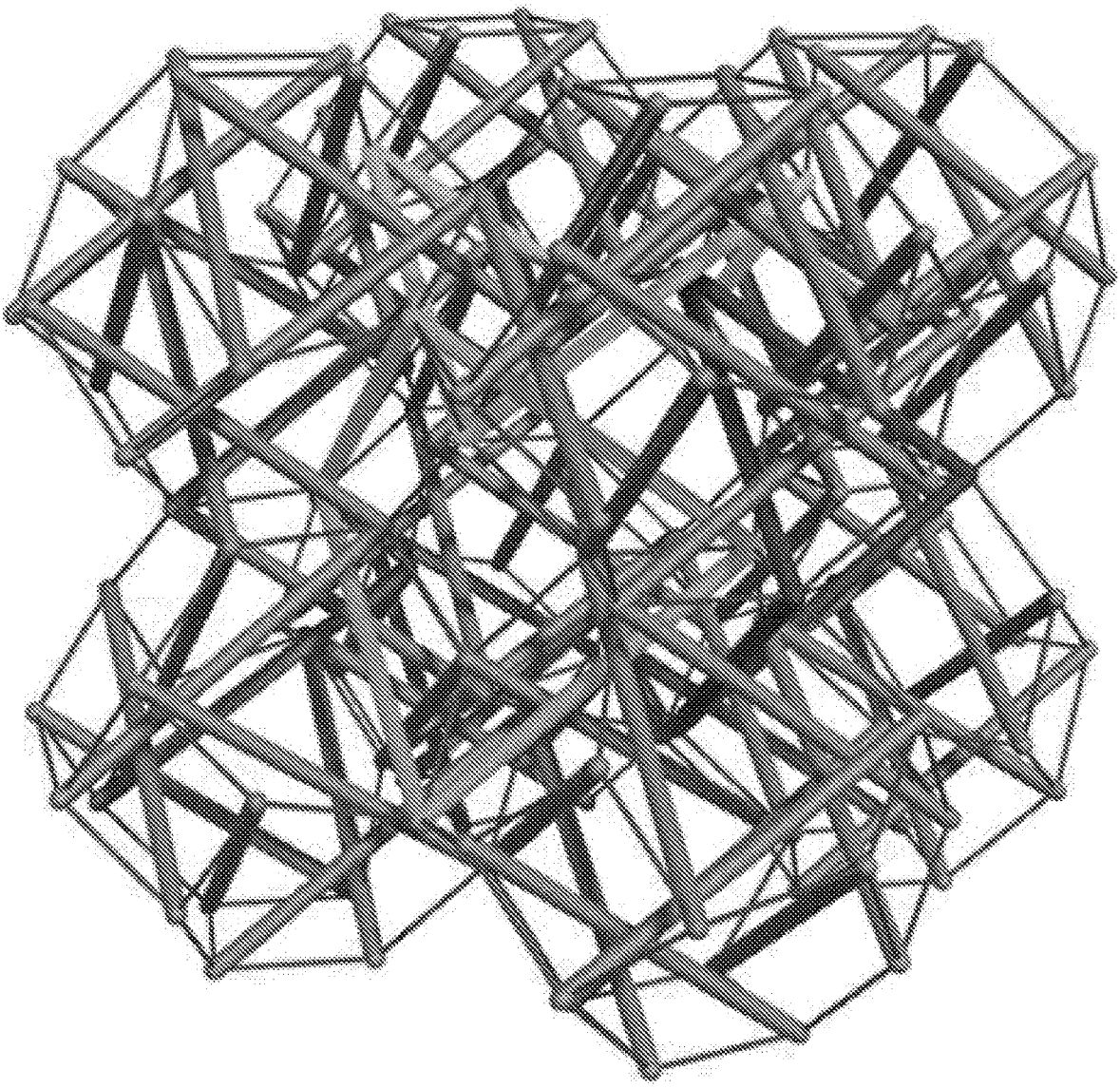

Finally, the resulting system is reflected with respect to the plane corresponding to their front faces, obtaining in this way an eight-cell system (FIG. 9). By construction, the left, right, top, bottom, front, and back squares of the resulting eight-cell unit have coincident nodes. Consequently, this system can be considered as a building block for three-dimensional tensegrity lattices, or in structural terms, tensegrity solids according to exemplary embodiments of the present invention.

As a result of these reflections, the nodes of the four squares corresponding to the top face coincide with those at the bottom, and the same occurs with the other combinations. Once again, all squares remain in the planes defining a cube, with no associated twist or distortion.

It is worth noting that by following this procedure not only is a unit cell generated with translational symmetry, but it also ensures that there are no continuum compression paths that extend throughout the lattice. The present invention of reflections generates an inventive unit cell with translational symmetry and no continuum compression paths that extend throughout the lattice.

Figure 8:
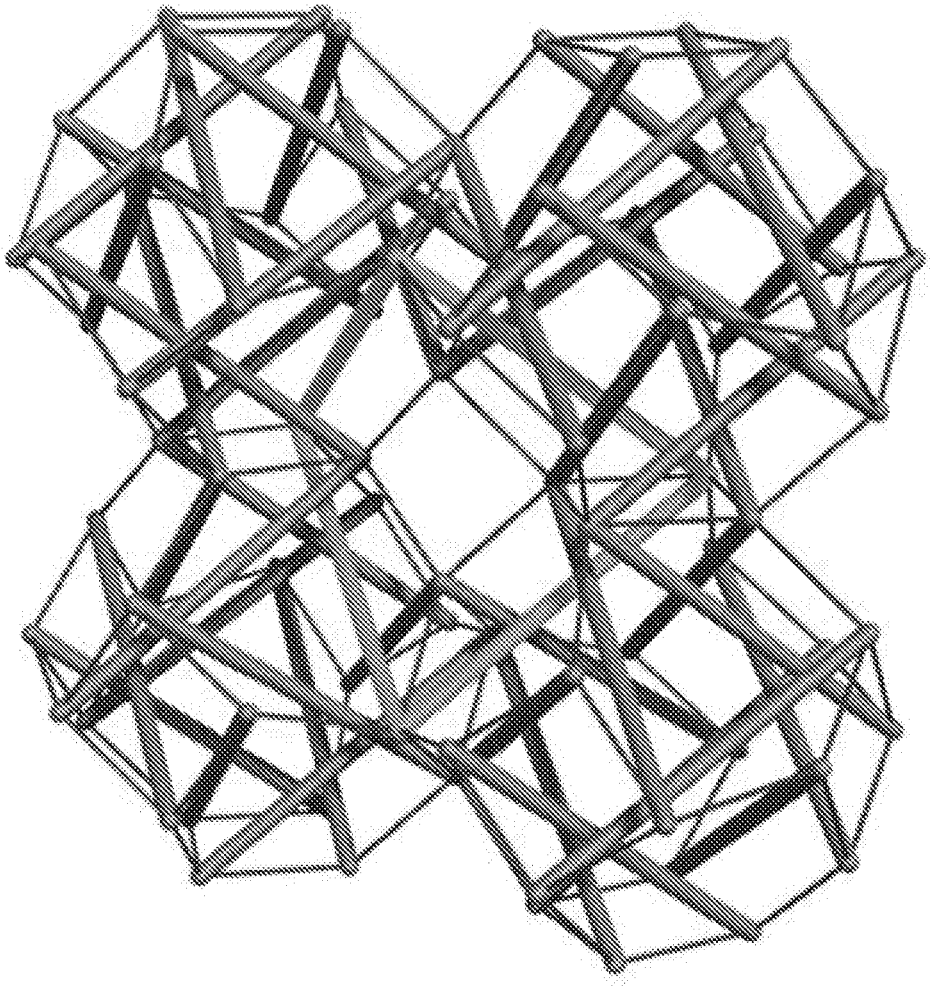

By applying the inventive successive reflection operations, closed compression loops are generated that resemble a folded rhomboid, as depicted by the set of highlighted bars in FIGS. 8-9. In FIG. 9, three of these closed-loops are highlighted. Each of them has a symmetric counterpart on the opposite side of the cube, totaling six closed loops for the unit cell. Importantly, the bars that do not form closed loops are either isolated from other bars or form two-bar V-shape arrangements. All of them become part of closed loops once unit cells are stacked against each other to form a three-dimensional lattice.

In the case of an infinite lattice, in an exemplary embodiment of the present invention, every single bar in the structure is part of a closed compression loop, with loops connected to each other exclusively through cables. In this way, the present construction recreates the concept of isolated compression islands in a sea of tension, in the spirit of Fuller's definition of tensegrity.

Modeling Tensegrity Lattices

Traditional approaches for modeling the behavior of tensegrity structures have their origin in form-finding applications or in models based on their quasi-static behavior. Consequently, most analysis techniques for this kind of systems rely on one or more of the following fundamental assumptions: (i) bars are perfectly rigid; (ii) cables are linear elastic; and/or (iii) bars experience pure compression and cables pure tension. In addition, in the quasi-static regime, all members of tensegrity structures experience either compressive or tensile loads.

This lack of complex stress states—such as bending or shear—implies that failure of tensegrity members can only occur through buckling (for bars) and yielding (for cables). Thus, common design methods for tensegrity systems assume that the structure would fail whenever one of its bars reaches its Euler buckling load.

These assumptions are generally adequate for form-finding and many quasi-static problems. However, in large deformation quasi-static problems as well as in dynamic situations, such as those that arise from impact events, these simplifications tend to break down: bar members could undergo significant deformations, and the presence of body forces imply that both bars and cables can suffer off-axis (bending and shear) loads.

This, in turn, can drastically affect the load distribution within the structure, rendering traditional approaches invalid. In this regard, some attempts have been made to account for bar deformations and nonlinearities, either through fully Lagrangian or co-rotational formulations of the Finite Element Method. It is worth noting that such models generally lack the simplicity and elegance of traditional methods for analyzing tensegrity structures, and typically require the use of excessive computational resources, rendering them impractical for modeling large structures as those arising when considering three-dimensional lattices.

For the purposes of the present invention, three-dimensional tensegrity lattices are analyzed by combining two recently developed models: one for the dynamic and post-buckling behavior of tensegrity structures, and the other one for geometrically nonlinear lattices composed of linear and angular springs. Both models are complementary: the first one provides a description of a continuum tensegrity structure that is based on discrete linear and angular springs, and this discretization is precisely the kind of system for which the second model was developed.

Reduced Order Discrete Model

Figure 10:
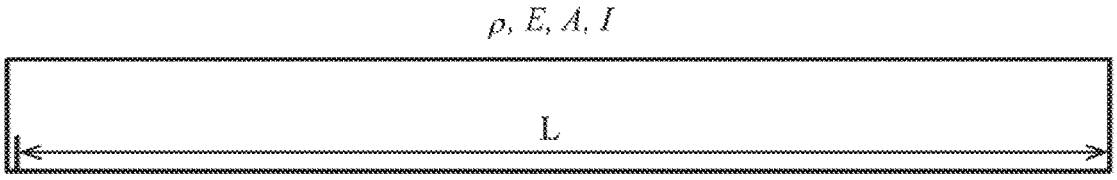
FIGS. 10-11 are schematics of the discretization scheme used in the discrete model. The continuum bar shown
Figure 11:
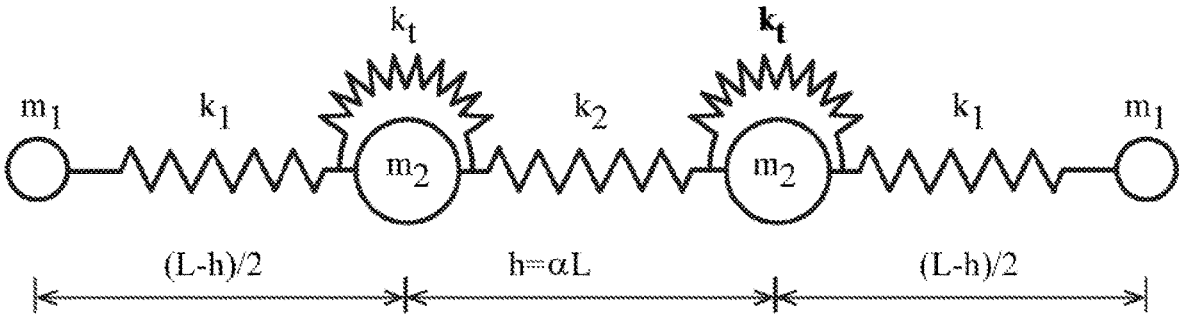

Consider a bar of length L and constant cross-section as depicted in FIG. 10. Let A be its cross-sectional area and I the corresponding moment of inertia. The bar is made of homogeneous material with mass density ρ and Young's modulus E. The bar is discretized through a set of four masses, three linear springs, and two angular springs as depicted in FIG. 11.

Required for this discrete system in order to capture the main features of the continuum bar that are relevant for the problem under consideration include: first, enforce for the discrete system to have the same overall axial stiffness as the continuum bar. This is easily attained by specifying the following values for the stiffness of the linear springs:

$$k_1 = \frac{2EA}{L-h} = \frac{2EA}{L-(1-\alpha)} \tag{1}$$

$$k_2 = \frac{EA}{h} = \frac{EA}{\alpha L} \tag{2}$$

where $h=\alpha L$ is expressed with $0<\alpha<1$ being another parameter of the discretization scheme to be determined later. Second, it would be beneficial for the discrete system to have the same total mass and mass moment of inertia as the continuum bar. This can be achieved by assigning the following values to the discrete masses:

$$m_1 = \frac{1}{6}\rho AL\left(\frac{1-3\alpha^2}{1-\alpha^2}\right) \tag{3}$$

-continued $$m_2 = \frac{1}{3}\rho AL\left(\frac{1}{1-\alpha^2}\right) \tag{4}$$

Then, it would be beneficial for the discrete system to have the same buckling load as the continuum bar. By computing the buckling load for the discrete system and equating it to that given by Euler's formula, it is possible to solve for the value of the angular stiffness such that this requirement is met, giving:

$$k_t = \frac{1-\alpha}{2}\frac{\pi^2 EI}{L}\left(1-\frac{I\pi^2}{AL^2}\right) \tag{5}$$

By adopting the parameters above, the discrete system has the same axial stiffness, mass, mass moment of inertia, and critical buckling load as the continuum bar. Moreover, it was found that this discretization scheme leads to an almost exact response of simply supported bars in the post-buckling regime, which is particularly appealing when modeling the large-deformation behavior of tensegrity structures.

Finally, for $\alpha=1/2$, the resulting model can reproduce, with a relatively low error of 4.5%, the first two natural frequencies of the continuum bar.

Finally, cables are modeled with the same discretization scheme as bars, with the difference that the angular stiffness is set to zero. In this way, cables automatically exhibit tension-compression asymmetry as their load bearing capability under compression (buckling load) is zero.

In summary, the adopted discretization scheme has the following properties:

(i) the total mass of the discrete system equals the mass of a continuum bar;

(ii) the mass moment of inertia of the discrete system matches that of the continuum bar;

(iii) the discrete system naturally buckles at the Euler buckling load of the continuum bar;

(iv) its post-buckling behavior closely follows the elastica solution; and (iv) the natural frequencies of the discrete system closely resemble the first two of the continuum bar.

Moreover, the same discretization is also applied to cables, automatically reflecting their inability to carry compressive loads. All of this is achieved with closed-form expressions for the mass and stiffness matrices, and with only 12 degrees of freedom per bar (or cable) for the three-dimensional case.

Continuum Model

Even though the discrete model can capture extremely rich details of the behavior of tensegrity structures with relatively few degrees of freedom, its computational cost can become prohibitive when trying to capture the effective response of large tensegrity lattices. Thus, the discrete model may be adopted for cases in which either the local dynamics or global behavior of relatively small lattices is of interest.

When modeling a tensegrity lattice as a meta-material, its effective constitutive response at the macroscopic scale becomes much more relevant than its localized cell-level behavior. In this case, a continuum model able to capture the nonlinear response of the lattice is desired.

Recently a continuum model for nonlinear lattices under large deformations has been developed, which was applied to analyze the quasi-static and dynamic response of two-dimensional hexagonal lattices subject to large deformations. In its most general form, the model is well suited for lattices composed of masses and springs, both linear and angular. Thus, it is logical to combine this approach with the discrete model to obtain the effective response of three-dimensional tensegrity lattices. A caveat of the problem under consideration is that the unit cells of the present invention are relatively large. In the present approach, numerical simulations are performed at the unit cell level to obtain the effective response of the lattice.

The strain energy density functional of the equivalent continuum medium is equal to the potential energy of the lattice normalized by the lattice volume. The equivalent continuum behavior is obtained by solving a discretized problem, for example, by using finite elements. A key assumption is a separation of length scales between the characteristic length scales of the finite element solution and the lattice. The length scale of the continuum solution is assumed to be much larger than the lattice unit cell size. It is further assumed that the length scale associated with variation of deformation gradient (averaged over a unit cell) is much larger than a unit cell size. Hence, a first-order homogenization is used. Indeed, if the length scale of the deformation gradient is of the order of unit cell size, then higher order homogenization methods would be required.

The continuum problem solution procedure involves solving a macro-scale problem by imposing boundary conditions on the full domain and solving using finite elements. At each quadrature point in the finite element solution, a micro-scale problem is solved by imposing the deformation gradient $F=I+\nabla u$ over a representative volume element (RVE) of the lattice under periodic boundary conditions. Note that the deformation gradient over the entire lattice domain is assumed to be slowly varying and the response at each point of the continuum is thus dominated by the constant part of this deformation gradient function. Consequently, for a first-order homogenization, only affine deformations (constant deformation gradient) imposed on a lattice RVE are considered. This micro-scale problem yields the effective stress on the lattice RVE under the imposed deformation gradient and is used to solve the macro-scale problem. First, a procedure to get the equilibrium configuration of the lattice RVE under the imposed boundary conditions is developed. The corresponding effective stress and tangent stiffness tensors are then derived and variational formulation and numerical implementation for the continuum medium are presented.

Potential Energy Functional

To evaluate the effective continuum properties at a point occupied by the lattice under a particular deformed configuration, equilibrium of an infinite lattice subjected to the same deformed configuration is first solved. This infinite lattice is an idealization under the assumption of separation of length scales, and it is valid in the limit of the relative size of length scales of lattice to continuum going to zero. Since the lattice is periodic, it suffices to consider a single unit cell as the RVE of the present lattice.

Outlined first is the procedure to obtain the equilibrium solution of our unit cell RVE. The potential energy of a unit cell is the sum of potential energies of the bars and cables in the lattice. Consider the reduced-order model of a bar illustrated in FIGS. 10-11 in an arbitrary deformed configuration. To evaluate the energy, note that the change in length of the springs and the angles between segments having torsional springs can be determined from the position of the two interior $m_2$ masses relative to the $m_1$ masses at the ends. Since the bar interacts only with its neighboring bars at the ends, applying force and moment equilibrium on the bar shows that the bar can only support axial forces at its ends. By symmetry, the change in length of the two segments having $k_1$ springs are equal, and the angles between the springs $k_1$ and $k_2$ (at the two $m_2$ masses) are equal in the buckled configuration. The potential energy of each bar (or cable) is given by:

$$P_{bar}=k_1(\Delta L_1)^2+k_2(\Delta\theta)^2+\tfrac{1}{2}k_2(\Delta L_2)^2 \tag{6}$$

where $\Delta L_1$, $\Delta L_2$ and $\theta$ are, respectively, the change in length of the first and second segments, and the change in angle between them. The deformed configuration can be uniquely determined when the end positions of the bar are prescribed by minimizing the above potential energy with respect to the coordinates of the mass $m_2$. Again, using symmetry, one need only to determine the horizontal and vertical coordinates of one of the interior $m_2$ masses. After solving for the bar configuration, in subsequent computations, the degrees of freedom associated with the interior $m_2$ masses are condensed out and the effective behavior, i.e., stiffness or force response of a bar (or cable) is expressed solely as a function of the end coordinates.

Consider the unit cell shown in FIG. 9. It has 48 interior nodes and 96 boundary nodes, with 96/6=16 nodes on each face. The origin is fixed at the center of the unit cell, and let 2L be the length of the cube enclosing the unit cell. The three coordinate axes are chosen to be normal to the faces of the cube. Let $X_i$ and $x_i$ denote, respectively, the coordinates of node i in the reference (at F=I) and deformed configurations. Under periodic boundary conditions, the nodes at the surfaces x=L, y=L, z=L have identical displacement corresponding to the nodes at x=−L, y=−L, z=−L. The nodes at these two sets of surfaces are designated as master and slave nodes, respectively, with each slave node associated with a unique master node. Finally, the interior nodes are denoted by $x_i$, and let $x_f$ be a vector having the collection of interior and master nodes.

Next, subject an infinite lattice to affine deformation F at its boundary and consider an arbitrary unit cell in the interior. If all unit cells deform identically (periodic boundary conditions), and imposing displacement continuity and force equilibrium at the boundary nodes of this unit cell with its adjacent unit cells, leads to the following constraints for the positions x and forces f between the master and slave nodes:

$$x_s=x_mF(X_s-X_M),f_s+f_m=0. \tag{7}$$

Note that the forces in Equation (7) expression are internal forces on a node due to a single unit cell. The equilibrium configuration is obtained by minimizing the energy of a single unit cell subject to periodic boundary conditions in Equation (7). Let P be the potential energy of the unit cell and it is solely a function of the nodal coordinates. The minimization problem giving the equilibrium condition leads to the following relations:

$$\frac{\partial P}{\partial x_i}=0,\ \frac{\partial P}{\partial x_m}+\frac{\partial P}{\partial x_s}=0, \tag{8}$$

$$\frac{\partial^2 P}{\partial x_f\partial x_f}\gtrsim 0, \tag{9}$$

$$x_s=x_m+F(X_s-X_m), \tag{10}$$

$$x_0=0. \tag{11}$$

The term on the left in Equation (9) is the stiffness matrix and its positive definitiveness is enforced to ensure that the equilibrium solution is stable. Equation (11) fixes the first node to prevent zero-energy rigid body translations of the RVE. Note that rigid body rotations are not zero-energy under periodic boundary conditions. To solve the above system, a combination of Newton-Raphson and conjugate gradient solvers is employed.

Equivalent Stress and Consistent Tangent Stiffness

The energy in a unit cell is a function of solely the deformation gradient F, and hence the lattice can be modeled as a hyper-elastic material. The strain energy density functional W of the equivalent continuum material is assumed to be equal to the potential energy of the unit cell normalized by the cell volume and the derivatives of this normalized energy with respect to the deformation gradient give the first Piola Kirchhoff stress T and stiffness or first elasticity tensors:

$$T=\frac{\partial W}{\partial F},\ \mathbb{C}=\frac{\partial^2 W}{\partial F\partial F} \tag{12}$$

Note from the above expression that, in general, $T_{ij}(F)$ # $T_{ji}(F)$.

As the strain energy density is the potential energy of the unit cell normalized by its volume, it is solely determined by the nodal coordinates at equilibrium and is written as $W(F)=\tilde{W}(x_i, x_m, x_s)$. From the constraint Equation (7), express the slave node coordinates $x_s$ may be expressed in terms of the master node coordinates and deformation gradient F. Recalling that $x_f$ is a vector having the interior and master nodes, the energy functional associated with the unit cell may be written as $W(F)=\overline{W}(F,x_f)$.

The first Piola-Kirchhoff stress is given by:

$$T=\frac{\partial W}{\partial F}=\frac{\partial \overline{W}}{\partial F}+\left(\frac{\partial \overline{W}}{\partial x_f}\right)\frac{\partial x_f}{\partial F} \tag{13}$$

The expression within the bracket in the second term equals zero and it is the equilibrium condition. To evaluate the first term in Equation (13), note from Equation (10) that the slave nodes $x_s$ are an explicit function of the deformation gradient and the master node coordinates. Expanding this first term using chain rule with $N_s$=48 coordinates $x_s$ of the slave nodes leads to:

$$T=\sum_{p=1}^{N_s}\left(\frac{\partial W}{\partial x_{sp}}\right)\frac{\partial x_{sp}}{\partial F}=\sum_{p=1}^{N_s}\frac{\partial W}{\partial x_{sp}}\otimes(x_{sp}-x_{mp}) \tag{14}$$

where the tensor product of two vectors is given by $(a\otimes b)_{ij}=a_ib_j$ and the last equality is obtained using Equation (10). The first elasticity tensor is obtained by taking the derivative of Equation (13) with respect to the deformation gradient F, leading to:

$$\mathbb{C}=\frac{\partial^2 \overline{W}}{\partial F\partial F}+\frac{\partial^2 \overline{W}}{\partial F\partial x}\frac{\partial x_f}{\partial F} \tag{15}$$

Since the equilibrium condition is satisfied for all deformation gradients, the following relation results:

$$\frac{d}{dF}\left(\frac{\partial \overline{W}}{\partial x^f}\right)=0 \Rightarrow \frac{\partial^2 \overline{W}}{\partial F \partial F}+\frac{\partial^2 \overline{W}}{\partial F \partial x^f}\frac{\partial x^f}{\partial F}=0 \tag{16}$$

Combining Equations (15-16) leads to the following expression for the stiffness tensor:

$$\mathbb{C}=\frac{\partial^2 \overline{W}}{\partial F \partial F}-\frac{\partial^2 \overline{W}}{\partial F \partial x_f}\left(\frac{\partial^2 \overline{W}}{\partial x^f \partial x^f}\right)^{-1}\frac{\partial^2 \overline{W}}{\partial x^f \partial F} \tag{17}$$

Again, the chain rule is invoked to evaluate the derivatives with respect to F appearing in Equation (17), which results in the following expression in indicial notation:

$$\frac{\partial^2 W}{\partial F_{ij}\partial F_{kl}}=\sum_{p=1}^{N_s}\sum_{q=1}^{N_s}\frac{\partial^2 W}{\partial x_i^p \partial x_j^q}X_j^p X_l^q,\ \frac{\partial^2 W}{\partial F_{ij}\partial x_k^f}=\sum_{p=1}^{N_s}\frac{\partial^2 W}{\partial x_i^p \partial x_k^f}X_j^p \tag{18}$$

Variational Formulation

The variational formulation can be used to study the behavior of an equivalent continuum material undergoing large deformations. Consider a body occupying a domain $\Omega \subset \mathbb{R}^2$ in the un-deformed reference configuration, subjected to an external traction $t_e$ over a part of the boundary $\partial\Omega_T$, while displacement is prescribed over the remaining part of the boundary $\partial\Omega_u=\partial\Omega\backslash\partial\Omega_T$. Let $\Gamma=\{v\in \mathcal{W}^{-1}(\Omega), v(x)=0\forall v\in\partial\Omega_u\}$ be the space of test functions having zero Dirichlet boundary conditions on $\partial\Omega_u$. The principle of virtual work is:

$$\int_\Omega v\cdot\nabla\cdot T dV+\int_{\partial\Omega_T} v\cdot(t-t_e)dS=0\forall v\in\Gamma \tag{19}$$

Note that the integrals, gradient operator, and vector $t_e$ are expressed in the reference configuration. Since the problem is nonlinear, an iterative procedure like Newton-Raphson is required to solve it. Let $u_k$ be the solution at the k-th iteration and let $u_{k+1}=u_k+u_\delta$. Applying integration by parts, and linearizing the first term in the principle of virtual work Equation (19) with respect to the incremental displacement $u_\delta$, leads to the following incremental variational formulation, which can be solved by a standard nonlinear finite element method:

$$\int_\Omega \forall v(\mathbb{C}\nabla v_\delta+T)dV+\int_{\partial\Omega T} v\cdot t_e=0\forall v\in\Gamma \tag{20}$$

Numerical Results

Having presented the design of the tensegrity lattice and an equivalent continuum formulation based on the analysis of a single unit cell, numerical results are shown displaying the mechanical properties of the present lattice. First, the effective behavior of an infinite lattice subjected to various affine deformations by analyzing the response of a single unit cell is studied. Then the yield strength of the lattice under tensile and compressive loadings is computed, and compared with the yield strength-density Ashby charts. Finally, the mechanical response of a finite tensegrity lattice impacting a rigid wall is analyzed via the full discrete model.

Unit Cell Behavior

The behavior of the unit cell under uniaxial tension is first analyzed. In this example, the material properties corresponding to titanium alloy Ti-6Al-4V, having Young's modulus E=91 GPa and yield strength $\sigma_y$=720 MPa, are used for both the cables and bars.

The dimensions of the unit cell are computed so that the bars under compression undergo purely elastic buckling, which would allow bars to recover even after severe deformation. Using the engineering Euler-Johnson criterion, elastic buckling of a simply supported column is ensured when:

$$L_b \geq \beta r_g\sqrt{\frac{2\pi^2 E}{\sigma_y}} \tag{21}$$

where $L_b$ is the length of the bar, $r_g$ the radius of gyration of its cross-section, and $\beta\geq1$ a safety factor. For a circular bar, the radius of gyration is $r_g=D_b/4$, where $D_b$ is the diameter of its cross section. Thus, adopting a safety factor $\beta=2$ results in:

$$D_b \geq \frac{L_b}{\pi}\sqrt{\frac{2\sigma_y}{E}} \tag{22}$$

It should be emphasized that, for this sizing criterion, the ratio $D_b/L_b$ is constant for a given material. Furthermore, for the given unit cell geometry, the ratio $L_b/L=0.46$, where L is the length of the (eight-cell) lattice unit cell. Consequently, these solutions are independent of the particular length scale chosen and all results are applicable if the bar, cable diameters and lengths are scaled proportionately with the unit cell span L. Indeed, note that both the energy and volume of the unit cell scale as $L^3$, and thus the effective stress computed, is independent of the actual dimensions of the unit cell. The stress is solely a function of the imposed strain, material properties, and the two relative dimensions: bar diameter to unit cell length ratio $D_b/L$ and cable to bar diameter ratio $D_c/D_b$.

For simplicity, the span of the unit cell in the coordinate directions is set to L=1 m, which results in bar length $L_b$=0.46 m. The corresponding bar diameter to ensure elastic buckling is then 1.8 cm. A cable diameter that is half that of the bar is adopted.

The cable pre-strain $\lambda$ is here defined as the ratio between the un-deformed length of the cable and the distance between two nodes connecting a cable in the canonical unit cell. For instance, $\lambda$=0.99 means that the un-deformed cable is 1% shorter than the distance connecting two nodes in the canonical unit cell. When a lattice with these cables and bars is assembled, the bars compress and the cables stretch leading to a new equilibrium position for the lattice.

The lattice is then termed to be under a pre-strain $\lambda$ and this equilibrium configuration is determined by minimizing the energy of a single unit cell with respect to the lattice co-ordinates subject only to the connectivity constraints. This equilibrium configuration is taken to be the reference configuration X of the lattice.

Solutions for four levels of pre-strain in the cables, corresponding to $\lambda$=1 (no pre-strain), 0.998, 0.995, and 0.993 are described hereinafter.

Figure 12:
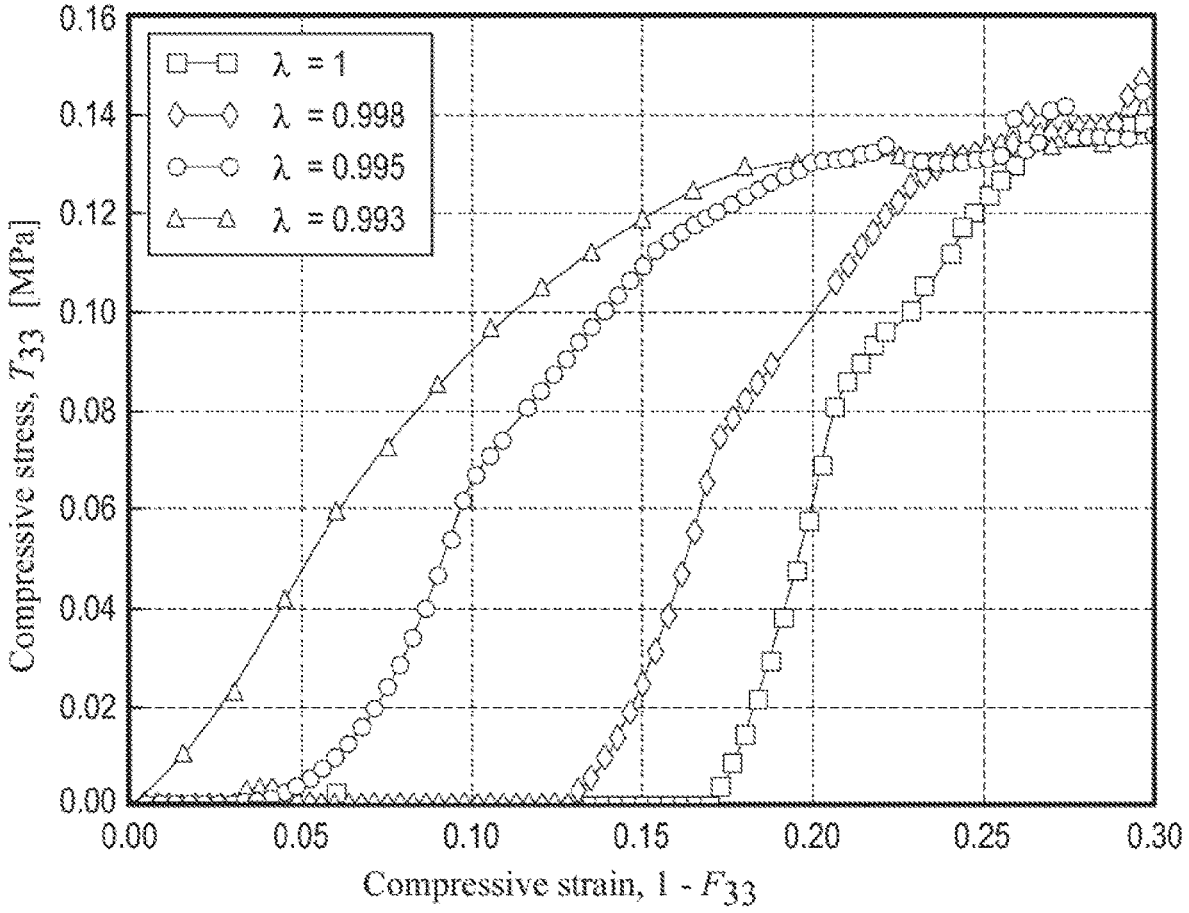
FIGS. 12-13 are graphs illustrating the present unit cell subjected to uniaxial strain, (FIG. 12) tensile and (FIG. 13) compressive along the $x_3$ direction for four distinct values of cable pre-strain $\lambda$. Large square markers show onset of plastic yielding in at least one of the lattice unit cell members.

In the first example, an affine deformation corresponding to uniaxial tensile strain in the $x_3$ direction is imposed on the lattice unit cell. The quasi-static response is governed by the system of Equations (8-11) and the stress is computed from Equation (14). FIG. 12 is a graph that displays the stress-strain response of the lattice for different levels of pre-strain. The large square markers show the onset of plastic yielding in at least one of the lattice unit cell members. In the present lattice inventions, yielding always starts at the cables. Note, however, that the results presented in FIG. 12 assume elastic behavior even after the onset of plastic yielding and are not representative of the post-yield lattice behavior.

When there is no pre-strain, both the bars and cables experience tensile stresses as the lattice is stretched. However, the situation becomes more complex in lattices with pre-strained cables. In this case, in the unloaded configuration, cables are under tension and bars under compression, with the intensity of the corresponding stresses depending on the imposed pre-strain (the higher the pre-strain, the higher the tensile stress on cables and compressive stress on bars). Since in this case cables are already in a tensile state, a lower uniaxial stretch of the lattice is required to reach the yield point. Furthermore, FIG. 12 shows that the stress $T_{33}$ at a given strain level is higher for lattices with low pre-strain. To explain this behavior, note that as a uniaxial tensile strain is imposed on the lattice unit cell, the bars, which are under compression in the un-deformed configuration, begin to relax by expanding and their strain energy decreases.

Simultaneously, the cables experience further tensile strain and their strain energy increases. The net effect of bars relaxing and cables experiencing further tensile strain results in a lower increase of energy compared to the zero pre-strain lattice. This explains why, although counterintuitive at first, the effective stress $T_{33}$, which is related to the change in unit cell potential energy as a uniaxial tensile strain is imposed (cf. Equation (12)), increases more rapidly when the pre-strain is lower. In summary, as the pre-strain increases, both the effective tensile stress on the lattice and the strain at which yielding starts, decrease.

Figure 13:
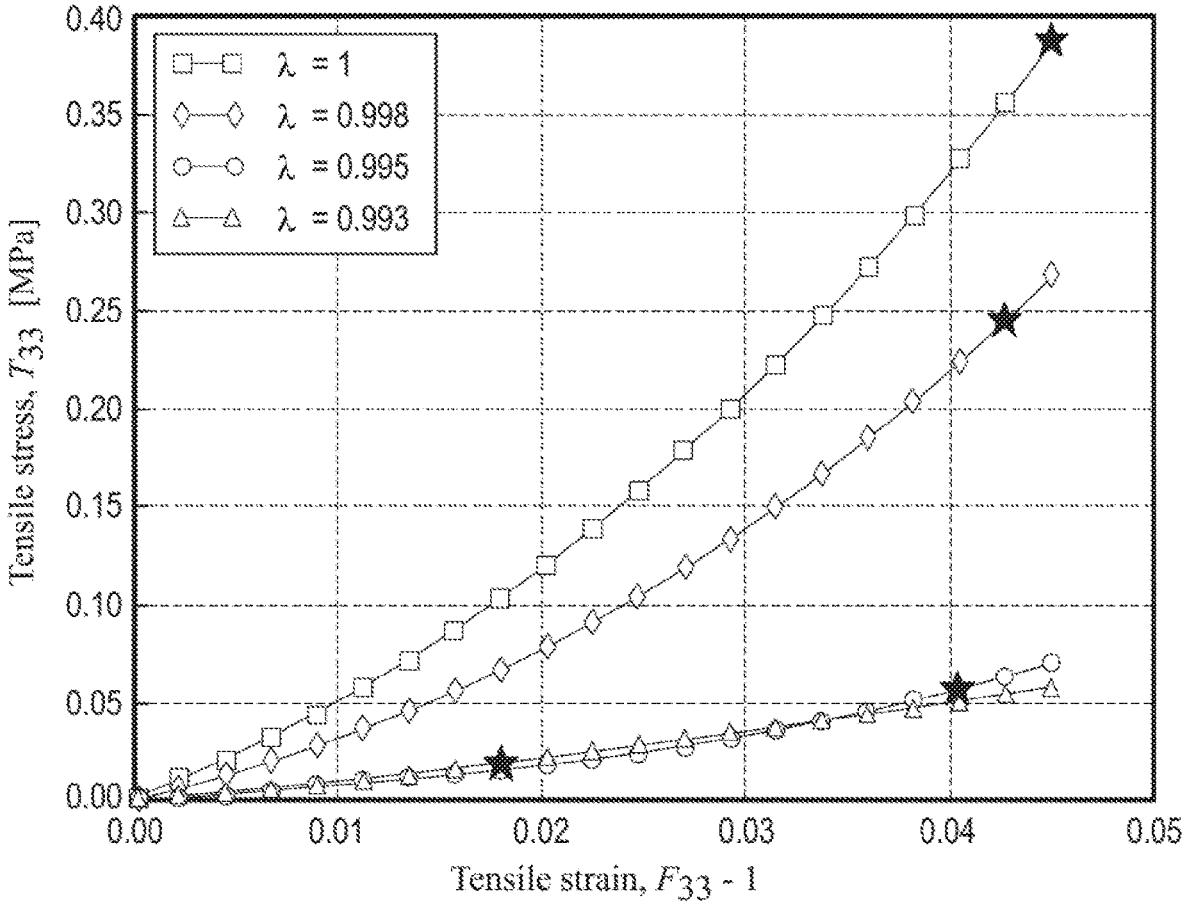

FIG. 13 is a graph that displays the compressive stress-strain response of the lattice unit cell for the same four values of pre-strain $\lambda$. For low levels of lattice pre-strain, the stress is zero even for significant strains. The lattice deforms in such a way that none of the bars or cables undergo strain, and the stiffness in compression is zero. After a certain strain value is reached, the lattice members start deforming and the stress increases. The stress increases monotonically until the bars buckle, at which point the stress levels-off and does not increase further. For high levels of pre-strain ($\lambda$=0.993), it is possible to achieve non-zero stiffness in compression in the undeformed configuration.

To conclude with the analysis of these two examples, toughness of the lattice is herein defined as the area under the effective tensile stress-strain curve up to the point in which yielding occurs. From the tensile and compressive tests on a unit cell, it can be inferred that the lattice with zero pre-strain has a higher toughness and stiffness in tension, while it has zero stiffness until about 17% strain in compression. On the other hand, a lattice with high pre-strain (for example, A=0.993) has a lower stiffness and toughness in tension, but it has non-zero stiffness in compression even in the undeformed configuration. However, the peak load carrying capacity in compression is the same for all levels of pre-strain and it is a function of the elastic buckling strength of the bars, in a similar fashion to results reported for single tensegrity cells.

Figure 14:
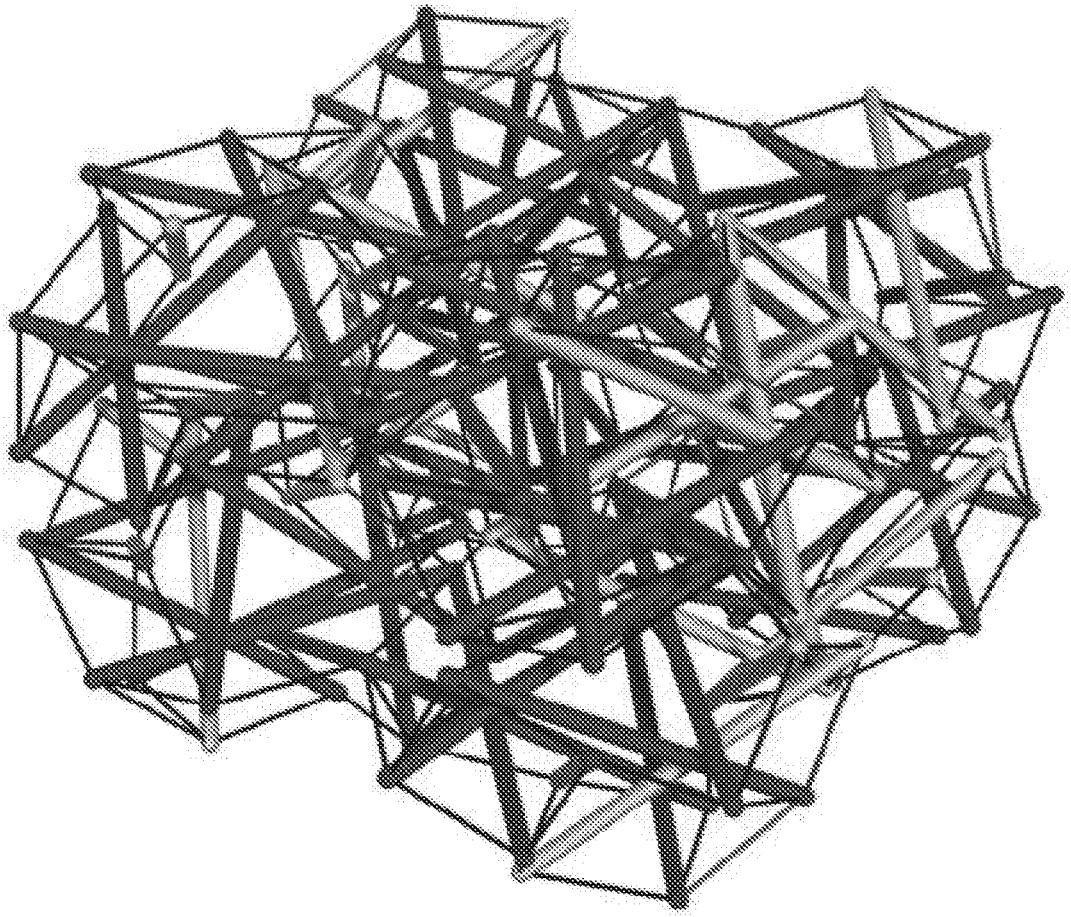
FIGS. 14-15 illustrate the deformed configuration of the lattice unit cell subjected to uniaxial compression along $x_3$ direction at strain $E_3=-0.3$.
Figure 15:
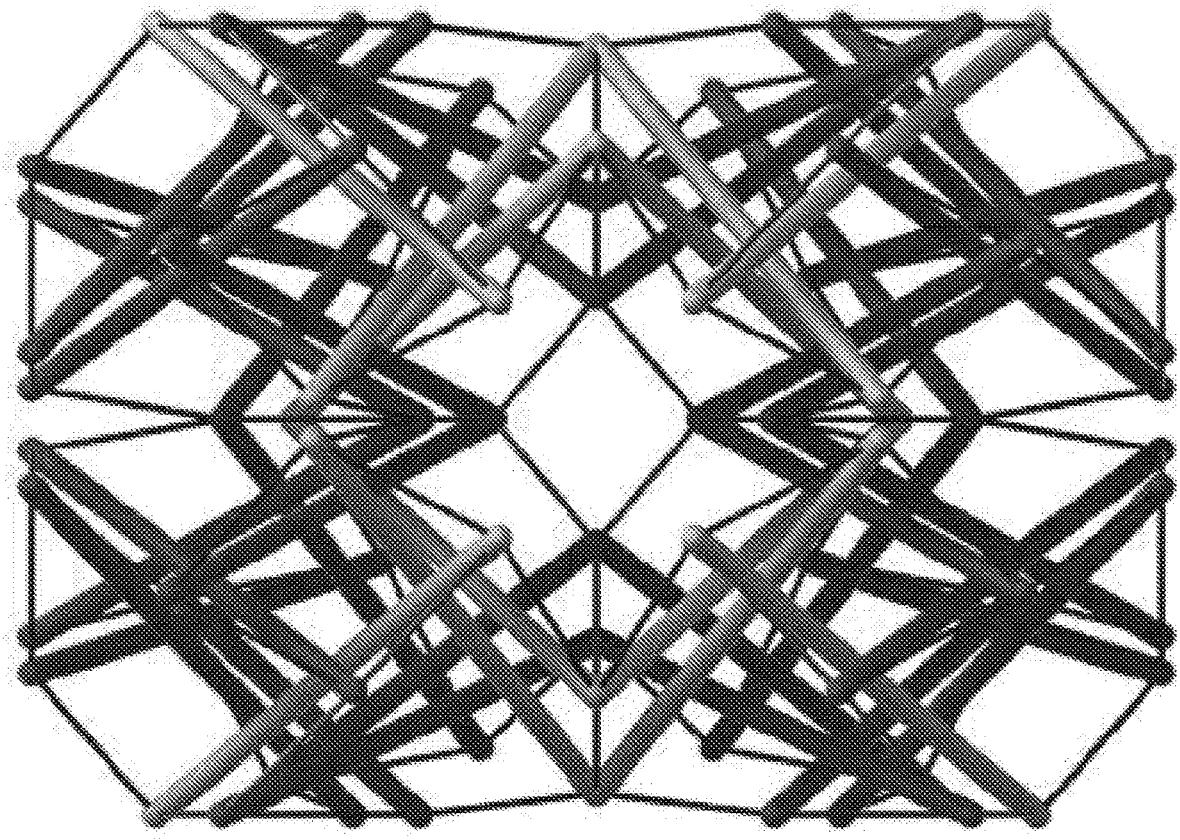

FIG. 14 displays a unit cell of the lattice in the deformed configuration at a compressive strain $F_{33}$=0.70. The lattice has zero pre-strain (A=1) in the undeformed configuration and it has the same material properties as discussed hereinbefore. FIG. 14 shows an isometric view of the lattice, while FIG. 15 shows a side view in the $x_1x_2$-plane of the lattice.

The bars are all under compressive stress and are shown in highlighted thick lines, while the cables experience tensile stress and are represented by thin lines. Note that when the lattice is under compression, the cables experience tensile stress. This observation can be explained by considering the geometry and connectivity of the lattice.

As discussed earlier, the bars form closed loops of four members in the lattice. Thus, every node has two bars and they are not co-linear. Now, consider the equilibrium of a single unit cell, where the cables and bars form a convex envelope of a sphere. If both the bars at a node are under compression, then the cables at the node must be in tension to ensure force equilibrium at the node. Indeed, this observation follows from the geometry and connectivity of the present tensegrity lattice. Thus, in contrast with conventional truss structures, part of the present lattice is always under tension even when the lattice is under compression.

Figure 16:
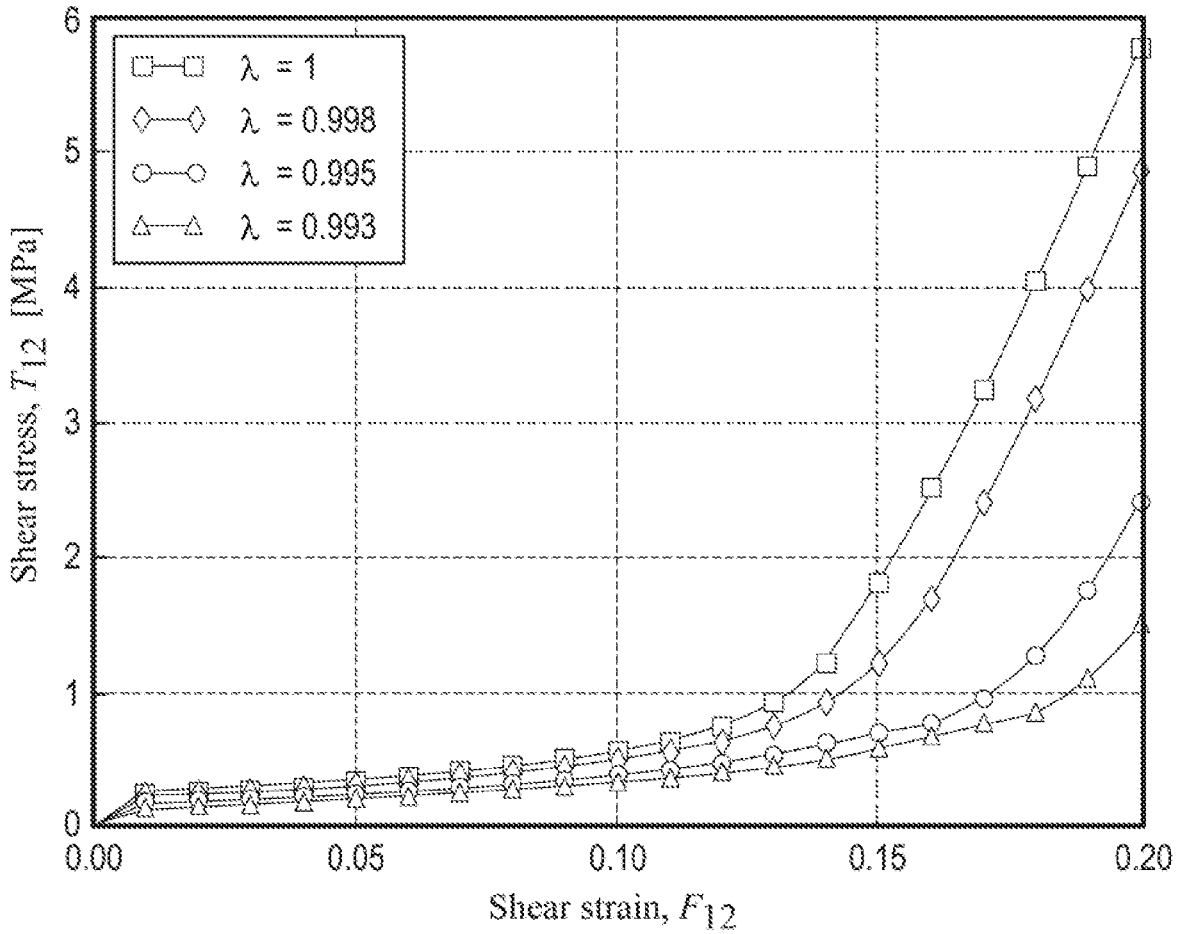
FIG. 16 is a graph of the stress-strain response of a Ti unit cell subjected to shear $F_{12}=F_{21}$. The response is nonlinear due to large deformation geometric effects.

A final example considers shear loading on a lattice unit cell. The material and geometric parameters of the lattice are the same as in the normal loading case discussed hereinbefore. The lattice unit cell is subjected to shear, with two non-zero shear strain components $F_{12}=F_{21}$. FIG. 16 is a graph that displays the $T_{12}$ component of stress with strain $F_{12}$. The stress increases monotonically with shear strain for all levels of lattice pre-strain and the stress is higher for a lattice with lower pre-strain.

Figure 17:
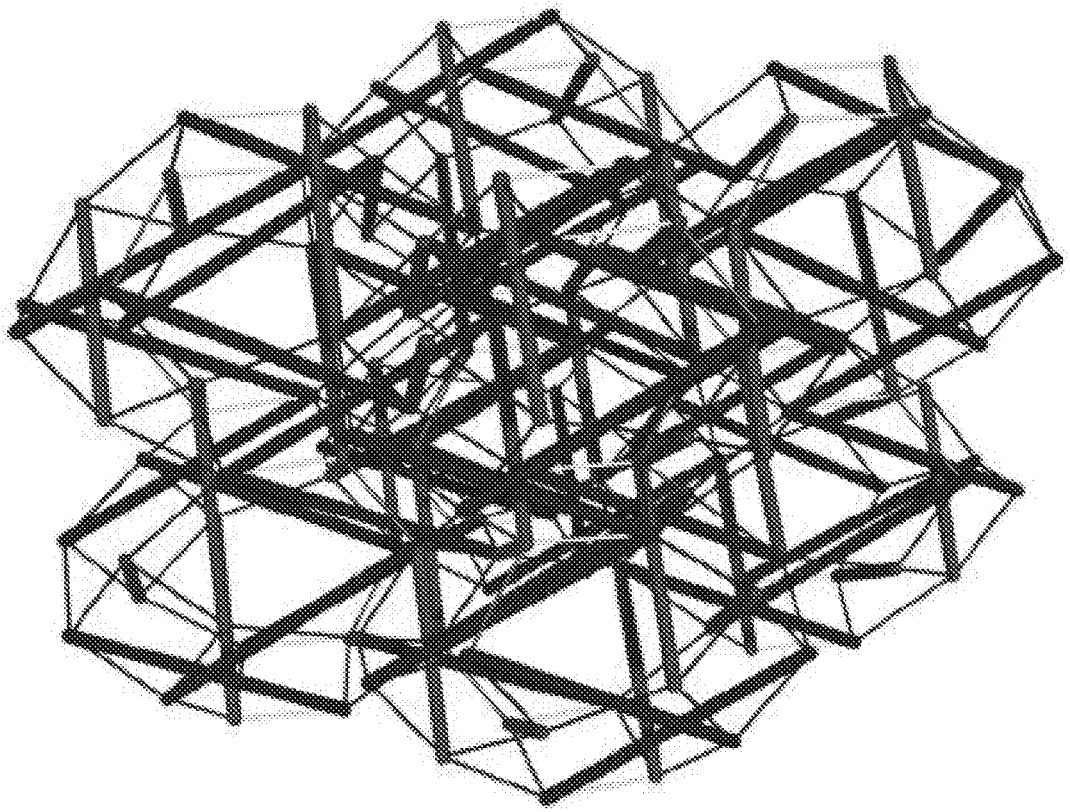
FIGS. 17-18 illustrate the deformed configuration of the lattice unit cell subjected to shear $\varepsilon_{12}=\varepsilon_{21}=0.25$.
Figure 18:
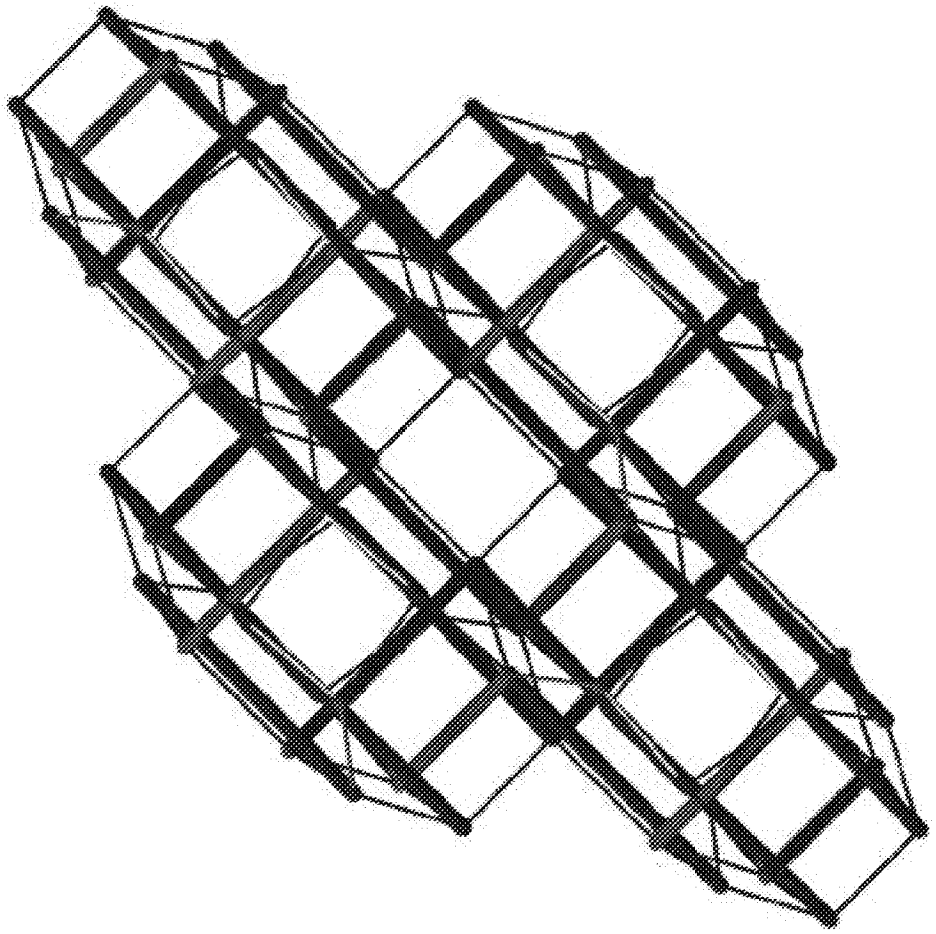

FIGS. 17-18 display the deformed lattice configuration of a unit cell subjected to a shear strain $F_{12}=F_{21}$=0.25. The light and dark lines denote compression and tension, respectively. Thick lines are used to represent bars, while thin ones depict cables. Note that some cables in the constant $x_3$ planes undergo rigid body translation and thus remain unstretched (thin lines—not highlighted). The bars are under a combination of tension and compression, as shear in the $x_1x_2$-plane can be decomposed into equal tension and compression along the 45° planes to the coordinate axes. This observation is consistent with the deformation pattern observed in the top view displayed in FIG. 17. Indeed, FIG. 17 shows that the bars along the $x_1=x_2$ direction (45° from the horizontal axis) are all in tension, while those along the $x_1=-x_2$ direction (145° from the horizontal axis) are all in compression. However—a note of caution—the shear deformation mode should not be construed as a simple linear superposition of the tensile and compressive loadings discussed hereinabove, since the behavior is nonlinear even for small strains. Indeed, this nonlinear and asymmetric behavior of the lattice under tension and compression is evident by comparing the stress-strain response in FIGS. 17-18

In summary, a rich and unique set of deformation behavior is demonstrated when an infinite tensegrity lattice is subjected to simple affine deformations. In particular, the geometry and connectivity of the lattice ensure that the cables are always under tension for the entire range of loading conditions considered here. Furthermore, pre-strain results in a lower effective stress in tension, but in a higher stress under compression, compared to lattices with zero pre-strain. These unique and inventive properties can potentially lead to dynamic behavior very distinct from conventional bulk media and truss-based lattice structures.

Yield Strength of Unit Cell

Having demonstrated the deformation response of a unit cell to uniaxial strain loading, attention is turned to quantifying the yield strength of the lattice for various characteristic parameters. Note from Equations (1-2) and (5-6) that the energy is a linear function of the Young's modulus E. Hence the stress, given by Equation (14), is also a linear function of E even for large deformations. Thus, it suffices to perform computations using a fictitious value of E=1 and extend the results to real materials by multiplying by the corresponding Young's modulus.

Similarly, the lattice density $\rho_l$ is given in terms of the material density $\rho_m$ by:

$$\rho_l = \rho_m \frac{\pi(96L_bD_b^2 + 288L_cD_c^2)}{L^3} \tag{23}$$

where L is the span of the undeformed unit cell along the coordinate directions, $D_{b(c)}$ and $L_{b(c)}$ are the diameters and lengths of the bars (cables), respectively. The lattice is said to undergo yielding when either a cable or bar yields under uniaxial tension. Since the axial stress on the bar or cable equals the material yield strength $\sigma_y$ at the onset of yield, the critical strain at this onset of yield is $\sigma_y/E$. Thus, the yield criterion in tensile loading is:

$$\max\{\varepsilon_b, \varepsilon_c\} = \sigma_y/E \tag{24}$$

where $\varepsilon_{b(c)}$ is the axial strain on the bar (cable).

Results for tensegrity lattices made of three materials: aluminum, titanium, and metallic glass, are illustrated with their material properties shown in TABLE 1. The results are computed for a range of bar and cable diameters. The bar diameter normalized by the span of the unit cell along the coordinate axes is 0.036 to prevent failure by plastic buckling under compression. For the chosen size of unit cell (L=1 m), this critical ratio corresponds to a diameter $D_b$=3.8 cm. Results for three values of bar diameter: $D_b$=0.4, 0.8, 1.6 cm are shown that are well below the plastic buckling threshold. The simulations are performed over a range of values of cable to bar diameter ratios $\eta \in \{0.5, 0.7, 0.8, 1, 1.2\}$.

TABLE 1

| Material | Density [kg/m$^3$] | Young's Modulus [GPa] | Yield Strength [MPa] |
|---|---|---|---|
| Aluminum | 2700 | 71 | 500 |
| Titanium | 4480 | 91 | 720 |
| Metallic Glass | 6000 | 95 | 1800 |

Material properties of tensegrity lattice base materials.

Note that the lattice would resemble truss structures for the last two values of $\eta$. As discussed, the stress and hence the yield strength is solely a function of the geometric ratios and independent of the actual physical dimensions of the unit cell. For a given material, the density of the unit cell is also solely dependent on the geometric ratios of cable and bar diameters to the unit cell length. Thus, the results presented here are independent of the actual physical dimensions of the unit cell and are applicable to any lattice, as long as the same geometric ratios are kept.

Figure 19:
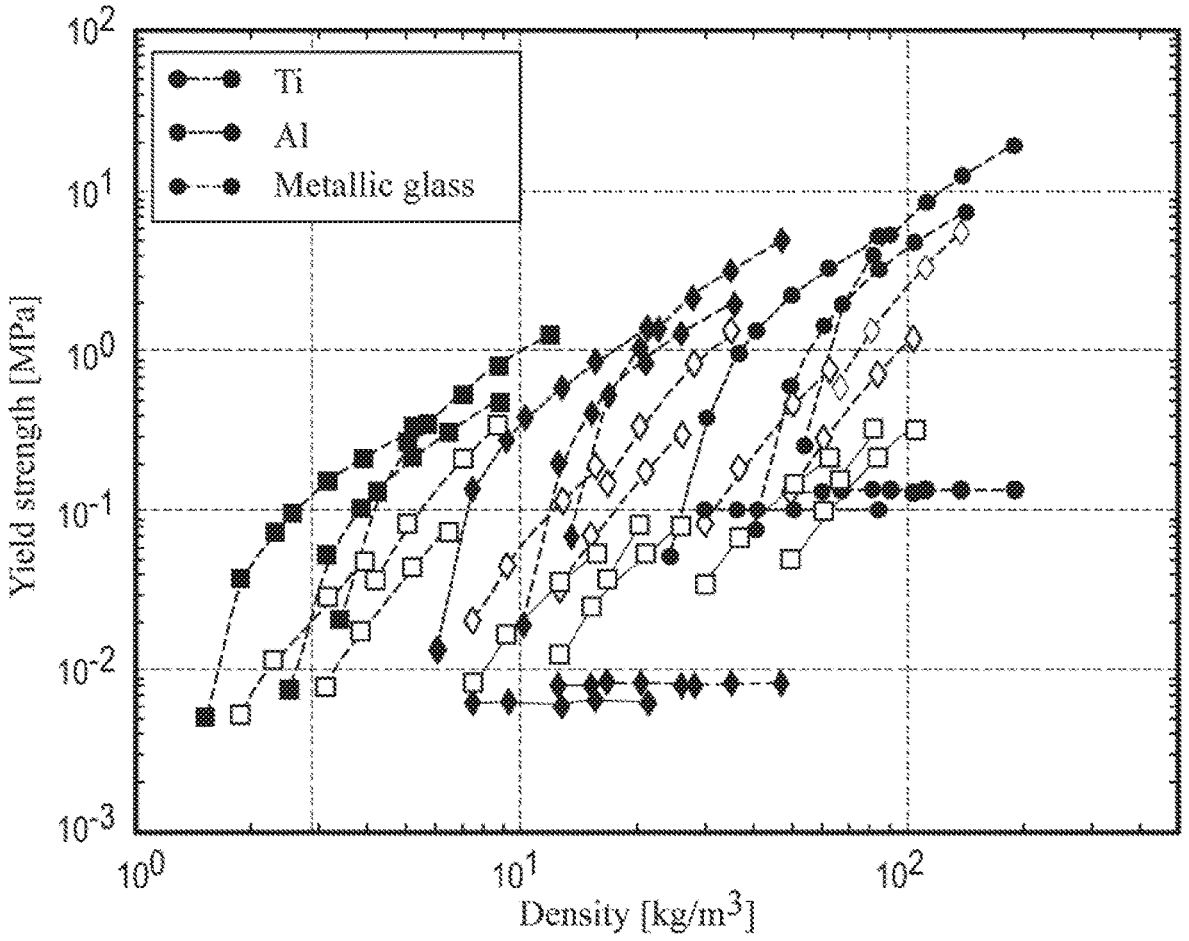
FIGS. 19-20 are graphs illustrating yield strength-density variation for tensegrity lattices made of three materials and having various diameters of cables and bars.
Figure 20:
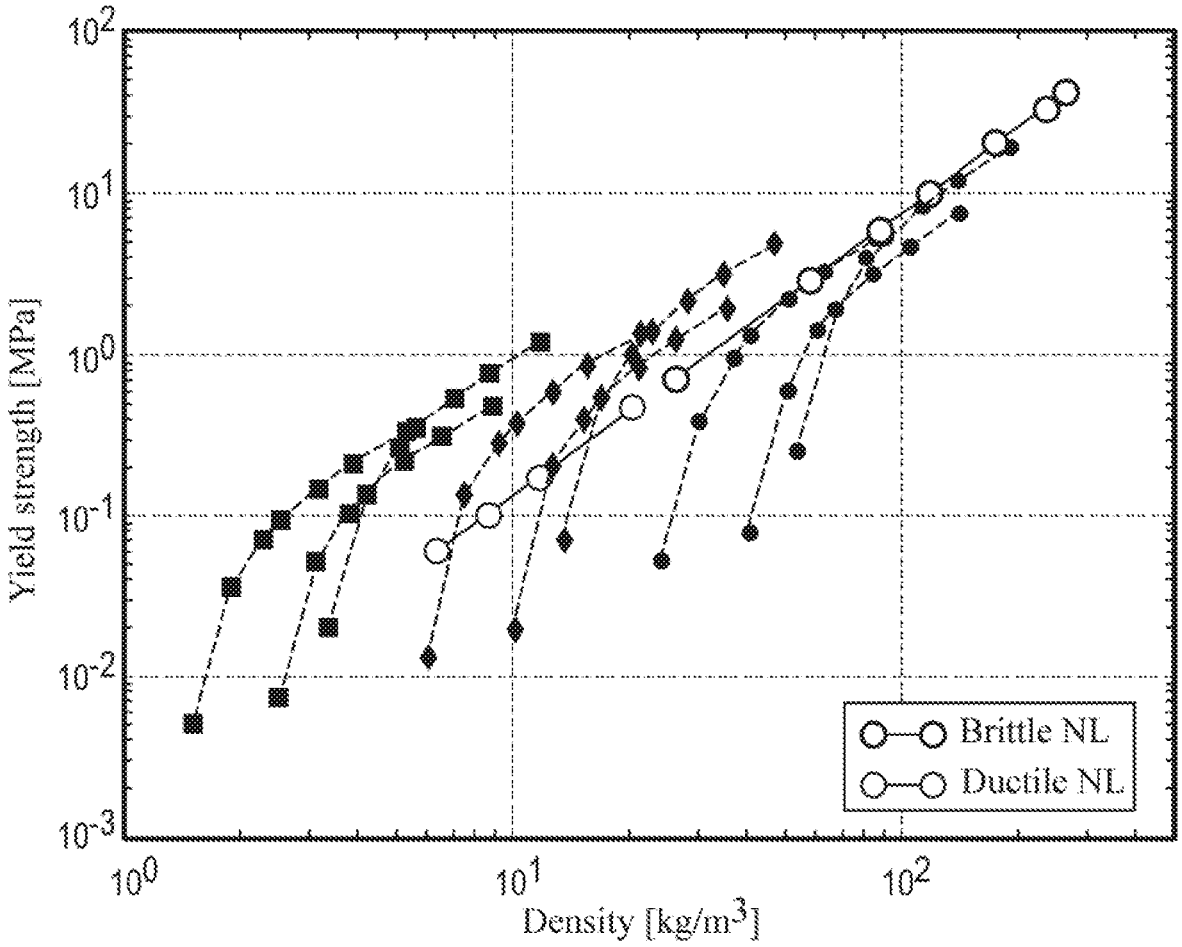

FIGS. 19-20 are graphs that illustrate the tensile and compressive yield strengths of the present tensegrity unit cells for the combination of cable and bar diameters enumerated above. The yield strength under both uni-axial strain and uniaxial stress conditions are shown. Uniaxial stress conditions are imposed by considering the deformation response of a single unit cell. The dashed (solid) curves correspond to tensile (compressive) yield strength and the hollow (filled) markers correspond to uniaxial stress (strain) loading.

Two sets of values for the three materials are observed in FIGS. 19-20. The lower set of values correspond to compressive yield strength. The markers lumped together correspond to a fixed bar diameter while varying the cable diameter over the range of values $\eta = D_c/D_b$ listed above. The failure in both tensile and compressive loading is due to the yielding of the cables under tensile strain. The yield strength values for both uniaxial stress and strain loadings are seen to be in the same range, with the tensile strength is higher in uniaxial strain, while the compressive strength is higher in uniaxial stress loading. However, note that the behavior is very distinct in both these loading cases, with the lattice having a significant Poisson effect under uniaxial stress loading, and being able to take more than 80% compressive strain without yielding. Furthermore, the effective stress reaches a constant value under uniaxial strain compressive loading, while under uniaxial stress loading, the stress continues to increase until the onset of failure.

The tensile strength is observed to be higher than the compressive yield strength, as the effective stress on the lattice is almost constant in the latter case when the bars are in the post-buckled configuration. Furthermore, under uniaxial strain loading, the yield strength is observed to be constant for a fixed bar diameter, independent of the cable diameter, since the strength depends on the elastic buckling load of the bar. In contrast, under tensile loading, all the members are in tension until the cable yields at a critical value of strain. Thus, the yield strength increases with increasing cable diameter $\eta$ for a fixed bar diameter. However, it should be noted that the effective behavior of the lattice is a nonlinear function of both the cable and bar diameters. Finally, the yield strength of the lattice also increases with increasing bar diameter.

The effective range of density and strength attained by the present tensegrity lattices places them in the domain of applications generally dominated by foams. In this range, very few materials can outperform foams, with the notable exception of the ceramic nanolattices. For purposes of illustration, FIG. 20 compares the tensile data of our lattices with the aforementioned ceramic ones.

Remarkably, for larger values of bar diameters, the yield strength to density scaling of the present lattices lies within the same range of brittle ceramic nanolattices. Furthermore, as the bar diameter is reduced, superior yield strength to density scaling is obtained for the present tensegrity lattices when compared to both the brittle and ductile nanolattices.

It should be emphasized that the behavior of the present lattices is independent of the length-scale, and that the results are valid independent of the characteristic dimensions of the lattice. Note that in contrast to earlier works involving hollow nanolattices, the present lattices show superior behavior even with solid bars and cables of macro-scale dimensions.

The superior yield strength in tension compared to existing natural and man-made materials is attributed to the nonlinear geometric effects associated with the present unit cell. As a final remark on the potential for further enhancement of mechanical properties of the present tensegrity lattices by optimizing the unit cell geometry and using multiple materials in the unit cell—the present results suggest that the framework presented herein forms the basis for the systematic design and analysis of tensegrity lattices with superior mechanical properties across the scales.

Wave Propagation on a Finite Tensegrity Lattice

Figure 21:
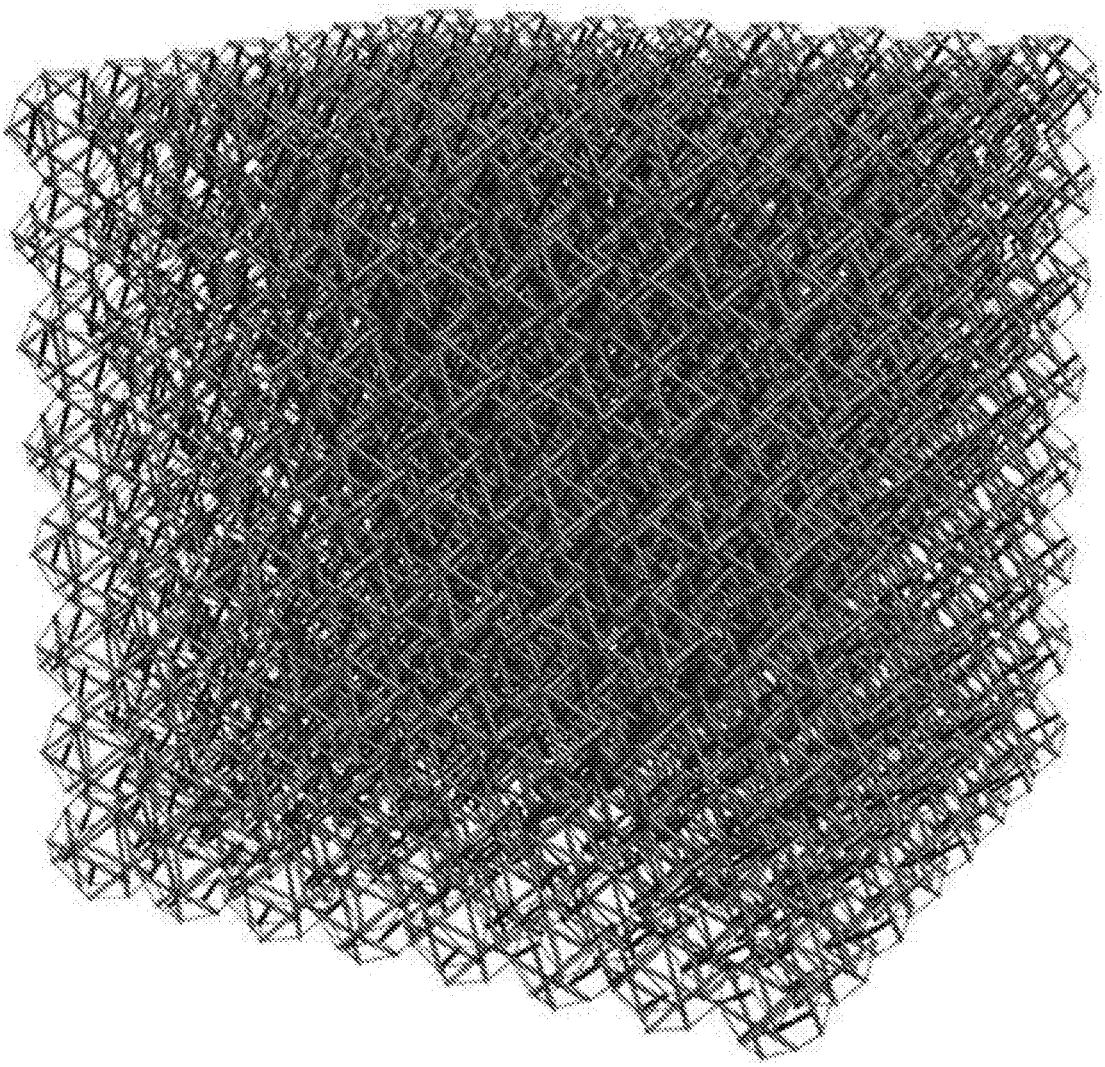
FIG. 21 is an exemplary three-dimensional tensegrity lattice considered for wave propagation analysis.
Figure 22:
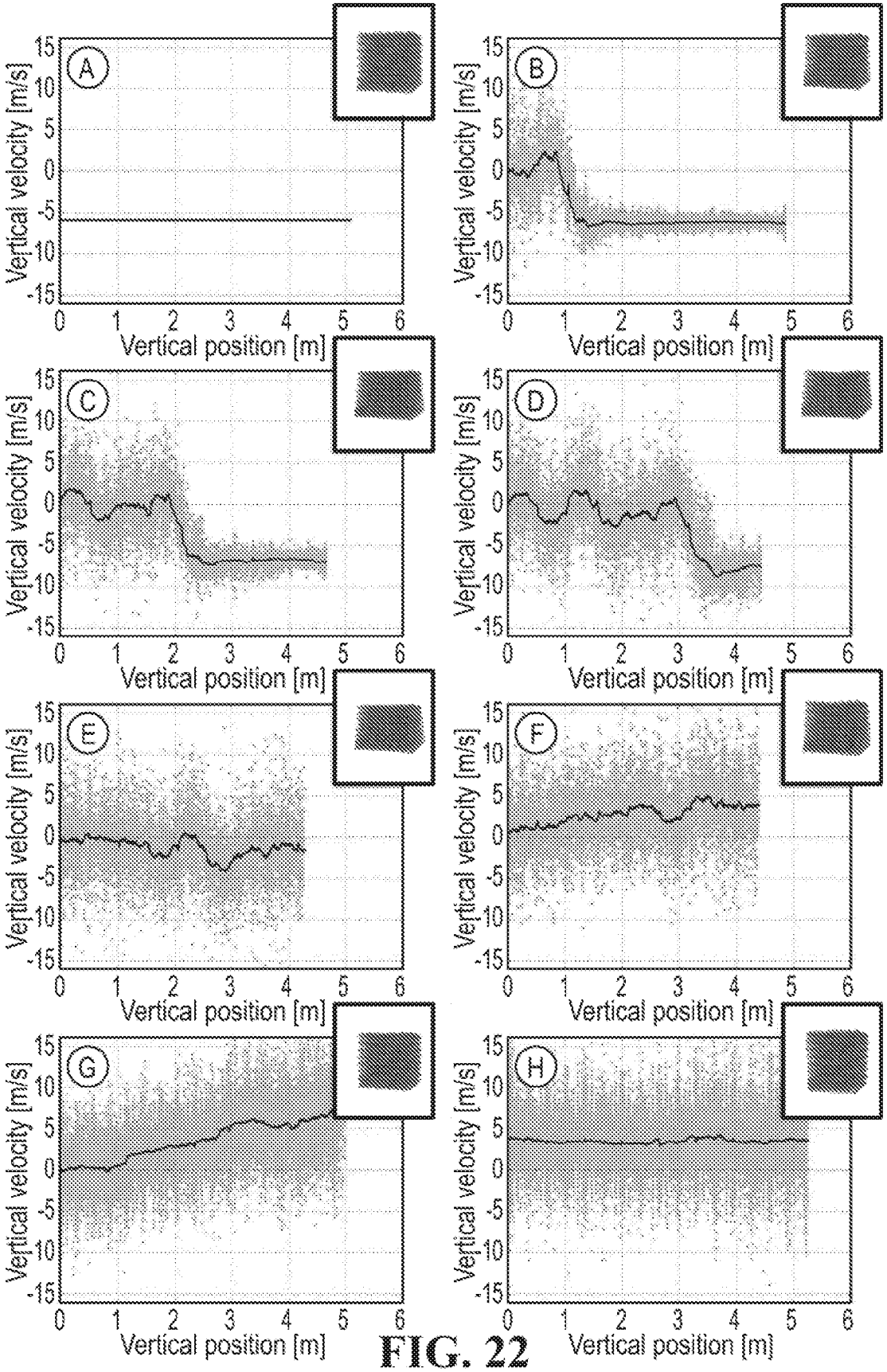
FIGS. 22A-H illustrate the temporal evolution a three-dimensional tensegrity lattice of the present invention impacting a wall.

The dynamic response of a finite tensegrity lattice impacting an elastic wall was also investigated. The exemplary lattice is composed of 8×8×8 elementary cells (or 4×4×4 unit cells), as shown in FIG. 21. The compression members are standard titanium bars with length $L_b$=58 cm, external diameter $\phi_b$=1.9 cm, and thickness t=1 mm. The cables are made of the same material as the bars and have diameter $\phi$=5 mm. Both bars and cables have Young's modulus E=91 GPa and density $\rho$=4,480 kg/m$^3$. The lattice is discretized using the model herein disclosed, and contact against the wall is implemented through a penalty method with wall constant $K_w=1\times10^6$ N/m.

FIGS. 22A-H illustrates the temporal evolution of the lattice. FIGS. 22A-H correspond to snapshots of the simulation at times t=0, 0.04, 0.07, 0.11, 0.13, 0.21, 0.28, and 0.36 s respectively, with t=0 s corresponding to the moment right before contact initiates. In each FIG. 22 is displayed: (i) the component of the velocity normal to the wall for each node of the discrete system as a function of the distance to the wall (light dots); (ii) a mean particle velocity obtained from a moving average of 1000 data points (dark continuous line); and (iii) an image showing the configuration of the lattice at the corresponding time.

FIGS. 22B-D clearly show a compression wave traveling from the wall (bottom face) towards the opposite side of the lattice (top face), and FIG. 22E displays the instant at which the wave reaches the wall. Points placed to the left of the wave exhibit almost no velocity whereas points on the opposite side of the wave-front travel at approximately the impact velocity $v=-6$ m/s. If the medium were non-dispersive, once the wave reaches the top wall, it should be reflected as an expansion wave with the velocity on its expanded side being of equal and opposite sign, i.e., $v=+6$ m/s. However, it is observed in FIGS. 22F-G that there is no clear reflected wave. Furthermore, the expansion of the lattice once the compressive wave reaches the top surface seems to be rather uniform until the lattice separates from the wall (FIG. 22H).

Figure 23:
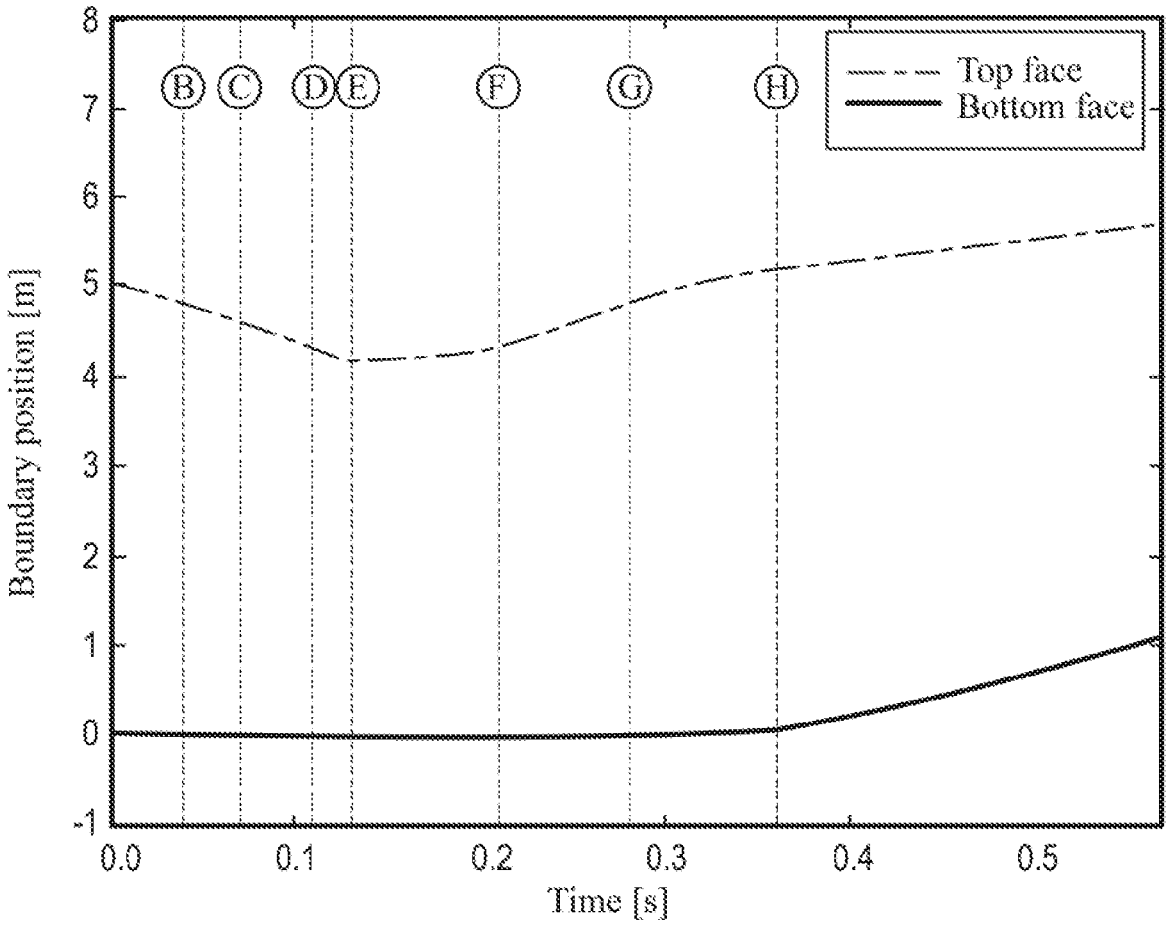
FIGS. 23-24 are graphs of position and mean velocity of the top a bottom faces of the lattice of FIGS. 22A-H.
Figure 24:
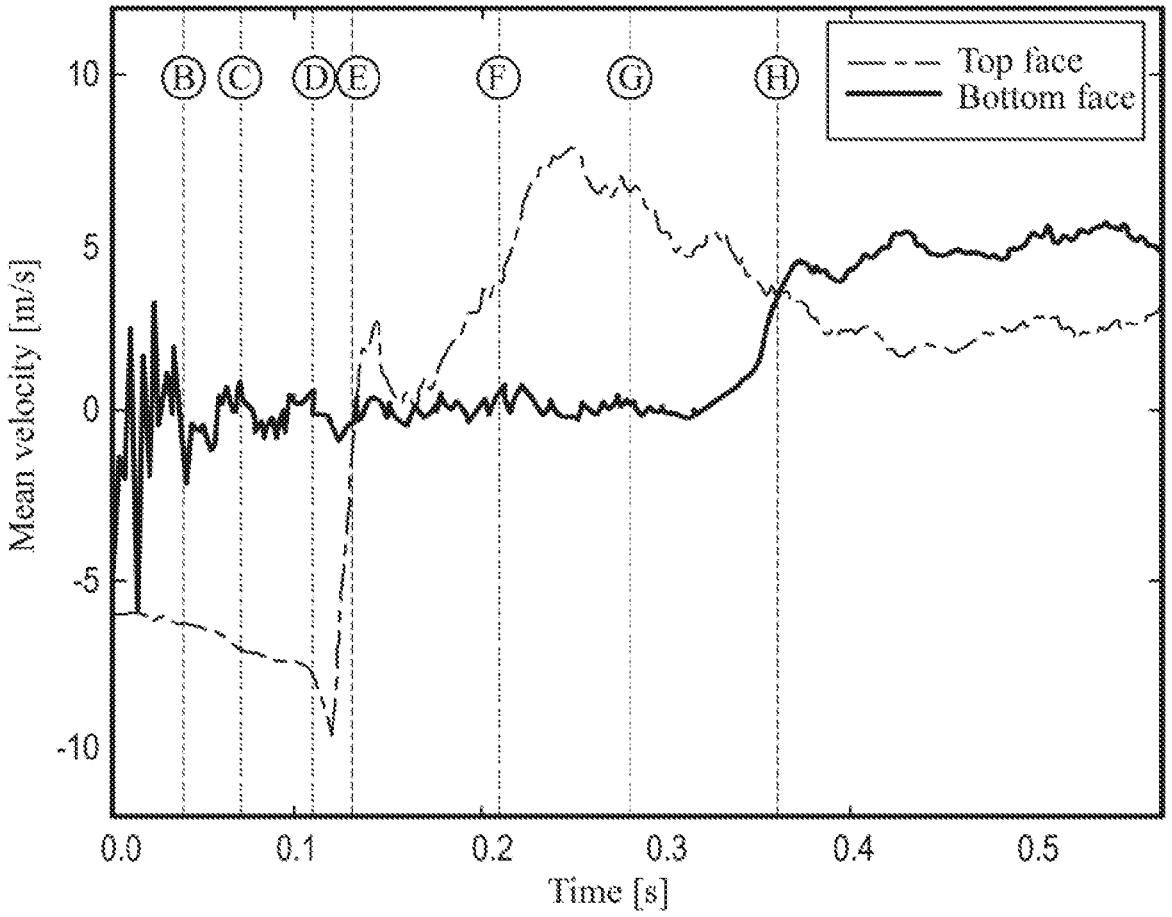

The asymmetric nature between the compressive and tensile stress waves traveling over the lattice is further highlighted in FIGS. 23-24. FIG. 23 shows the position of the top and bottom faces of the lattice, whereas FIG. 24 displays the corresponding mean velocity of the points on those faces. From the figures, four distinct stages are observed.

During the first stage, from the start of contact up to label E, a compressive wave travels through the body towards the top face. From FIG. 24 it is observed that the acceleration of the top face is initially very small and increases as time progresses. This is an indication that, even though at first this compressive wave seems to be non-dispersive, the contrary is true. The second stage occurs between the times corresponding to labels E and F. During this stage, the velocity on the top face remains very low when compared to the initial velocity of the lattice, and a reflected expansion wave slowly starts to buildup. This phenomenon highly contrasts with the typical sharp reflection of waves observed at the interfaces of non-dispersive materials.

One can observe the asymmetry between tension and compression in the transition from the first to the second stage. Notice how as one passes through label E, the bottom face velocity sharply increases from −10 m/s to zero. At this point, the lattice is undergoing compression (since velocity is negative). As the lattice starts to expand, after point E, it takes much longer to attain a velocity of 6 m/s. This shows that the lattice is more dispersive under tension when compared to compression, at least in the presence of a large compressive deformation. During the next stage, between labels F and H, the lattice expands almost uniformly until it finally reaches the last stage, after label H, during which the lattice is finally separated from the wall and oscillates between stretched and compressed states.

Figure 25:
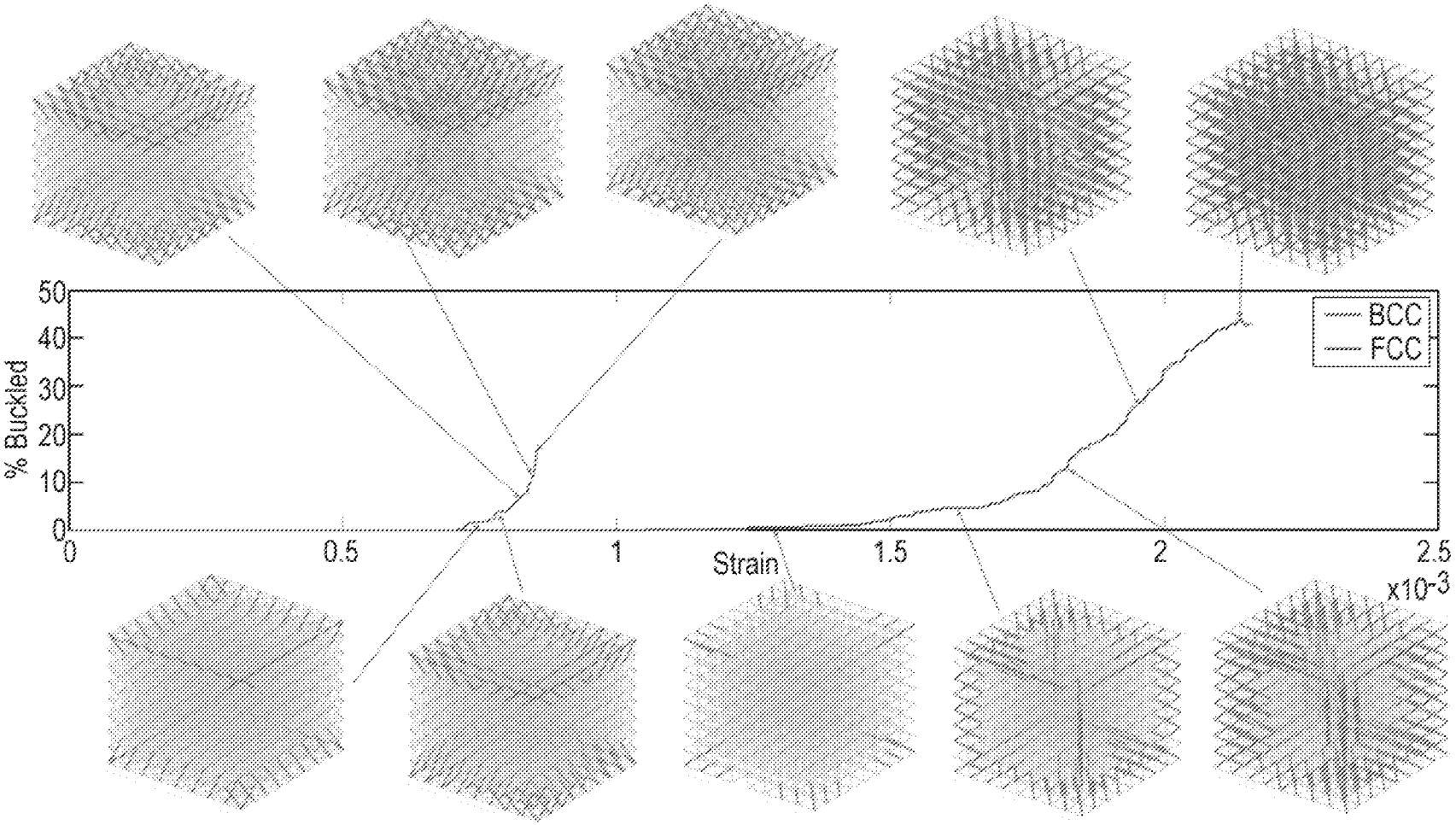
FIGS. 25-27 demonstrate some of the unique mechanical capabilities of tensegrity lattices when compared to traditional truss lattices, namely body-centered cubic (BCC) and face-centered cubic (FCC) lattices, assuming lattices of same total mass density.
Figure 26:
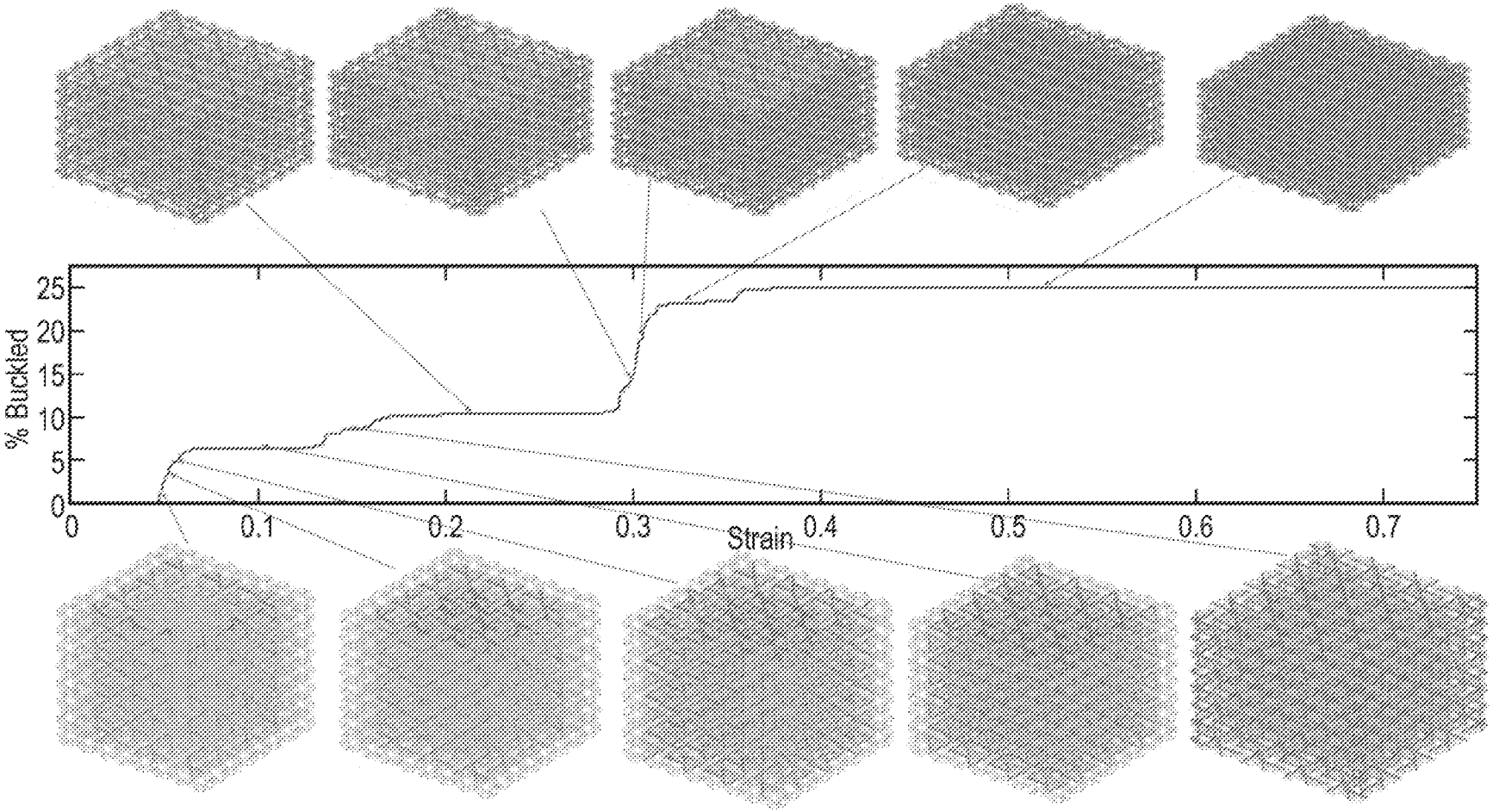
Figure 27:
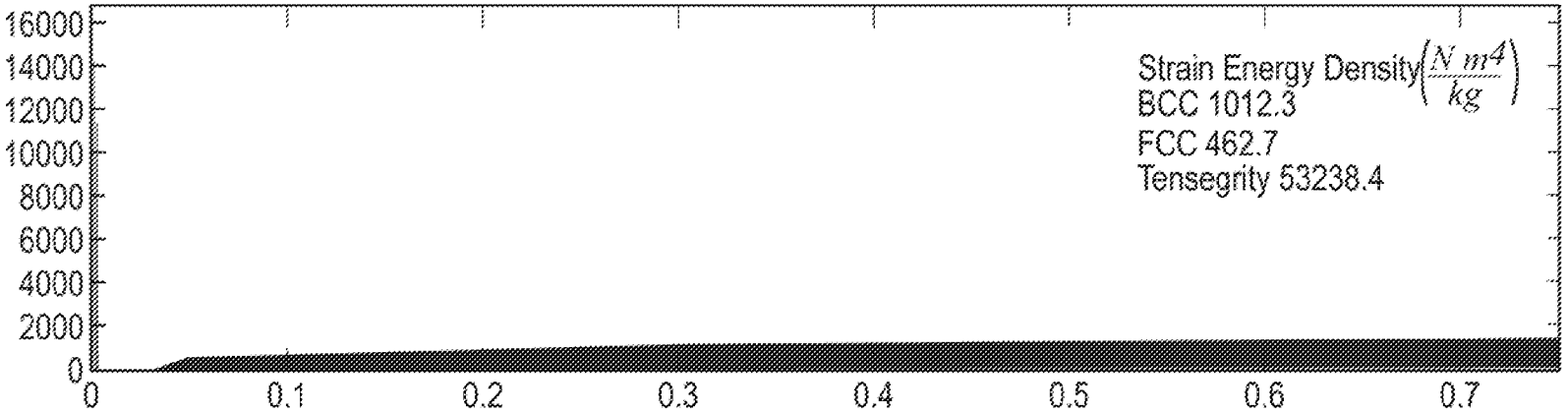

FIGS. 25-27 demonstrate some of the unique mechanical capabilities of tensegrity lattices when compared to traditional truss lattices, namely body-centered cubic (BCC) and face-centered cubic (FCC) lattices, assuming lattices of same total mass density. In FIG. 25 one can see the damage evolution on the BCC and FCC lattices in the form of buckled bars. Both curves stop when the lattices become globally unstable. Both lattices fail at relatively low strain (on the order of $1\times10^{-3}$), and most importantly their failure regions are localized.

FIG. 26 shows the same quantity for a tensegrity lattice. The lattice can withstand a significantly larger deformation without exhibiting global failure, even after multiple bar members have buckled. The simulations were arbitrarily stopped at a strain of 0.75 without seeing a global instability. This is a consequence of failure not localizing to specific regions in the lattice.

FIG. 27 shows the stress strain behavior of all three lattices. Traditional truss lattices (FCC and BCC) are stiffer, withstanding a larger maximum stress than the tensegrity lattice. However, they fail rapidly due to the aforementioned instability. The tensegrity lattice is more compliant and able to take a very large deformation. Consequently, the total strain energy density of the tensegrity lattice (the area below the curve) is much larger than that corresponding to the truss lattices. For this particular case, the amplification is a factor of 50 for the BCC lattice and over 100 for the FCC one.

Figure 28:
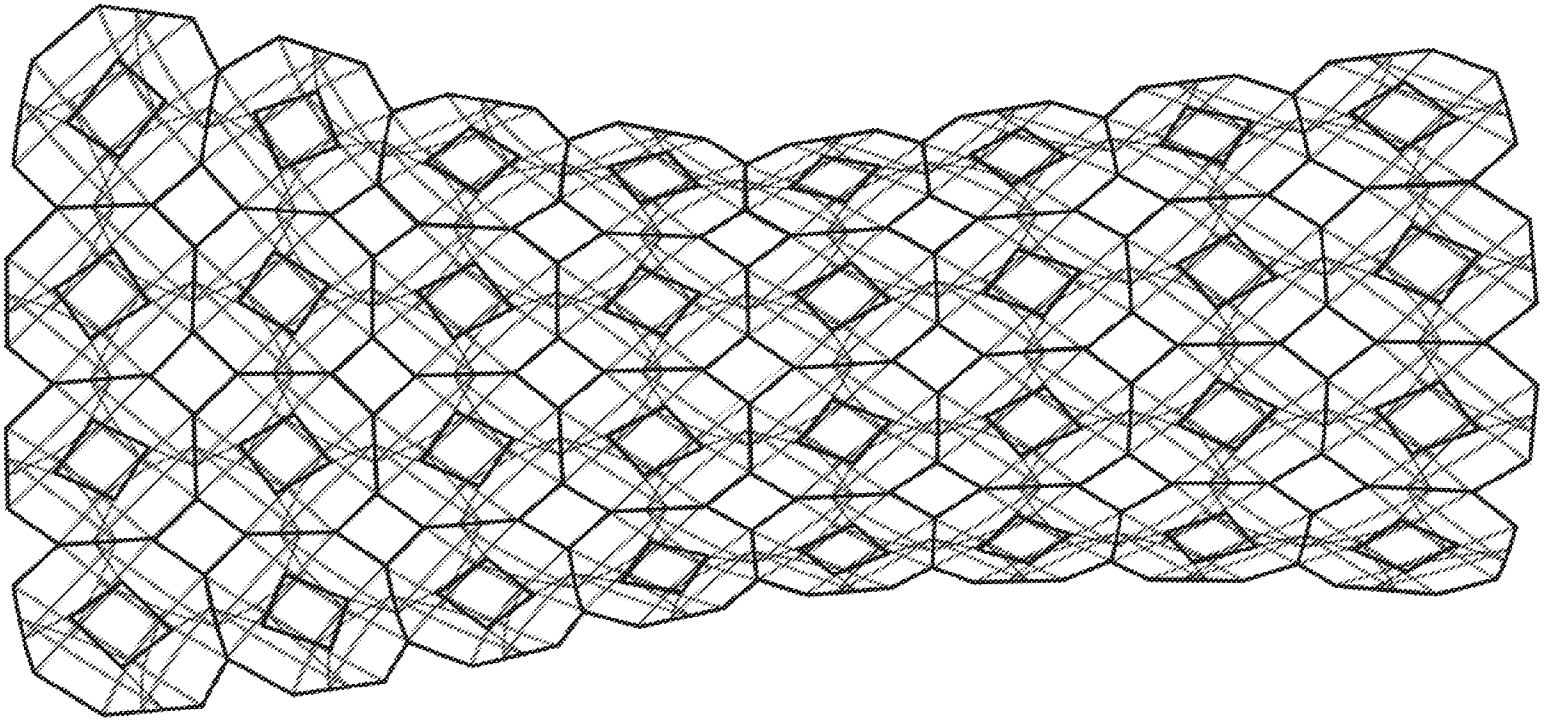
FIG. 28 depicts a three-dimensional tensegrity lattice according to an exemplary embodiment of the present invention, but as opposed to the examples shown in FIG. 4, the faces of the FIG. 28 three-dimensional tensegrity lattice are not perpendicular.

In another exemplary embodiment of the present invention, although the tensegrity elementary cell obtained from a truncated octahedron shown in FIG. 4 illustrates six square faces, which are parallel in pairs, with the planes containing each pair being perpendicular to those corresponding to the other two pairs, other geometries form the present invention. For example, as shown in FIG. 28, the essence of the present invention is a beneficial topology—meaning how bars and cables are connected to each other, e.g. forming the closed compression loops, V-shape arrangements and isolated bars. This topological property is preserved if the way these connections are established are as described throughout, but for example, the lengths of bars and cables are changed. In this way, more complex geometries are achieved.

The lattice of FIG. 28 is a three-dimensional tensegrity lattice, but the faces are no longer perpendicular. The lattice is shown from a side for clarity.

CONCLUSIONS

Even though there is an abundance of catalogs with well-known tensegrity shapes, and design methods have been developed to discover new tensegrity forms, the existence of three-dimensional tensegrity lattices has not been reported in the literature before. As disclosed, a method for generating an inventive three-dimensional tensegrity lattice is herein presented. The approach is based on the application of successive reflections to an elementary tensegrity cell to build a unit cell with translational symmetry. This technique allows for the building of tensegrity columns, plates, solids, and any combination of them.

Furthermore, bars in the unit cell form closed compression loops connected to each other exclusively through cables. In this way, the resulting tensegrity lattice is continuous in tension and discontinuous in compression, which provides precious post-buckling stability to this kind of structures.

A nonlinear homogenization method was adopted to study the effective response of the present tensegrity lattices. In contrast to earlier works involving hollow nanolattices, the present lattices show superior strength in the low-density regime, which depends only on lattice proportions and not on its scale. That is, it is possible to achieve tensegrity lattices with these excellent properties across the scales, all the way from metamaterials, to sandwich beam and plate cores, to large-scale civil, mechanical, and aerospace structures. This high performance is attributed to the nonlinear geometric effects and buckling associated with the unit cell.

Finally, the dynamic response of an 8×8×8 tensegrity lattice was analyzed by means of a discrete reduced-order model. It was observed that wave propagation in this kind of structure is highly dispersive and asymmetric. Consequently, the superior strength at low densities of the present tensegrity lattices, coupled with their resilience when subject to extremely large deformations and their dispersive and asymmetric nature when it comes to wave propagation, makes the present tensegrity-based metamaterials good candidates for energy absorption applications.

The present tensegrity-based lattices have enormous potential for developing metamaterials with unique static and dynamic properties. Potential future research directions include investigating the nature of localization associated with compression paths and optimizing the material properties of the various members. Also of potential interest is wave-guiding using these lightweight, but stiff, tensegrity lattice structures.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A three-dimensional tensegrity lattice comprising one or more elementary building blocks, each elementary building block comprising eight truncated octahedron elementary cells, each truncated octahedron elementary cell comprising six square faces that are parallel in pairs, wherein each face of a truncated octahedron elementary cell is defined by four nodes, wherein a group of four contiguous truncated octahedron elementary cells have coincident nodes, wherein each truncated octahedron elementary cell comprises:

compression members; and tensional members; and wherein compression members and tensional members are communicative at nodes, each node having at least one compression member-to-tensional member connection.

2. The lattice of claim 1, wherein the structure is globally stable after failure by buckling of individual compression members.

3. The lattice of claim 1, wherein a closed loop of four compression members, where every node of the closed loop has two compression members that are not co-linear, provides post-buckling stability to the structure.

4. A structure comprising the lattice of claim 1, wherein the structure is selected from the group consisting of a helmet, a bumper, a crash-resistant structure, and a planetary lander.

5. The lattice of claim 1, wherein the compression members have a compression member characteristic;

wherein the tensional members have a tensional member characteristic;

wherein the compression member characteristic is selected from the group consisting of material composition, length, shape, elasticity, and conductivity; and wherein the tensional member characteristic is selected from the group consisting of material composition, length, shape, elasticity, and conductivity.

6. The lattice of claim 5, wherein the structure is globally stable after failure by buckling of individual compression members; and wherein a closed loop of four compression members, where every node of the closed loop has two compression members that are not co-linear, provides post-buckling stability to the structure.

7. A structure comprising a three-dimensional tensegrity lattice formed from one or more elementary building blocks, each elementary building block comprising eight truncated octahedron elementary cells, each truncated octahedron elementary cell comprising six square faces, each face defined by four nodes, which six faces are parallel in three pairs, with the planes containing each pair being perpendicular to the planes corresponding to the other two pairs, the three pairs including a pair of right and left faces, a pair of top and bottom faces, and a pair of front and back faces, wherein each elementary building block is formed through three reflection operations:

a first reflection operation starting with a first zero-dimensional truncated octahedron elementary cell having no translational symmetry and obtaining a one-dimensional two-cell system that has a first translational symmetry in the direction normal to a reflection plane containing the right face of each of the cells of the two-cell system;

a second reflection operation starting with the one-dimensional two-cell system and obtaining a two-dimensional four-cell system that has the first translational symmetry and a second translational symmetry in the direction normal to a reflection plane containing the top face of each of the cells of the four-cell system; and a third reflection operation starting with the two-dimensional four-cell system and obtaining a three-dimensional eight-cell system that has the first translational symmetry, the second translational symmetry, and a third translational symmetry in the direction normal to a reflection plane containing the front face of each of the cells of the eight-cell system;

wherein a group of four contiguous truncated octahedron elementary cells have coincident nodes.

8. A structure comprising a three-dimensional tensegrity lattice formed from a plurality of truncated octahedron elementary cells;

wherein each truncated octahedron elementary cell comprises six square faces that are parallel in pairs;

wherein each face of a truncated octahedron elementary cell is defined by four nodes; and wherein a group of four contiguous truncated octahedron elementary cells have coincident nodes.

9. The structure of claim 8, wherein each truncated octahedron elementary cell comprises:

compression members; and tensional members;

wherein compression members and tensional members are communicative at nodes, each node having at least one compression member-to-tensional member connection.

10. The structure of claim 9, wherein at least a portion of the compression members:

form a closed loop of four compression members, where every node of the closed loop has two compression members that are not co-linear;

form a two-compression member V-shape arrangement at a node; or are isolated from other compression members via nodes without an additional compression member.

11. The structure of claim 10, wherein the structure is globally stable after failure by buckling of individual compression members.

12. The structure of claim 9, wherein at least a portion of the compression members form a closed loop of four compression members, where every node of the closed loop has two compression members that are not co-linear; and wherein each closed loop provides post-buckling stability to the structure.

13. The structure of claim 8, wherein the planes containing each parallel pair are perpendicular to those corresponding to the other two pairs.

14. The three-dimensional tensegrity lattice of claim 8, wherein the lattice has a total mass density, wherein when a traditional truss lattice selected from the group consisting of a body-centered cubic (BCC) lattice and a face-centered cubic (FCC) lattice having the same total mass density as the three-dimensional tensegrity lattice is subjected to a failure strain defined as the strain deforming the traditional truss lattice to the point where it becomes globally unstable, the three-dimensional tensegrity lattice is configured such that it can be subjected to a strain over 100 times the amount of the failure strain of the traditional truss lattice, yet remain globally stable.

15. The globally stable structure of claim 14, wherein the three-dimensional tensegrity lattice is configured such that it can be subjected to a strain over 500 times the amount of the failure strain of the traditional truss lattice, yet remain globally stable.

16. The globally stable structure of claim 14, wherein the three-dimensional tensegrity lattice is configured such that it can be subjected to a strain of up to 750 times the amount of the failure strain of the traditional truss lattice, yet remain globally stable.

17. The three-dimensional tensegrity lattice of claim 8, wherein the lattice has a total mass density, wherein when a traditional truss lattice selected from the group consisting of a body-centered cubic (BCC) lattice and a face-centered cubic (FCC) lattice having the same total mass density as the three-dimensional tensegrity lattice is subjected to a load to evaluate stress strain behavior, the total strain energy density of the three-dimensional tensegrity lattice is greater than the total strain energy density of the traditional truss lattice.

18. The globally stable structure of claim 17, wherein the total strain energy density of the three-dimensional tensegrity lattice is a factor of 50 times greater than the total strain energy density of the traditional truss lattice.

19. The globally stable structure of claim 17, wherein the total strain energy density of the three-dimensional tensegrity lattice is a factor of 100 times greater than the total strain energy density of the traditional truss lattice.

20. The structure of claim 8, wherein each truncated octahedron elementary cell comprises:

compression members having the same compression member characteristic; and tensional members having the same tensional member characteristic;

wherein compression members and tensional members are communicative at nodes, each node having at least one compression member-to-tensional member connection;

wherein the compression member characteristic is selected from the group consisting of material composition, length, shape, elasticity, and conductivity; and wherein the tensional member characteristic is selected from the group consisting of material composition, length, shape, elasticity, and conductivity.

21. A three-dimensional tensegrity lattice comprising one or more elementary building blocks, each elementary building block comprising a three-dimensional eight-cell system, wherein each cell is an eight truncated octahedron elementary cell, each truncated octahedron elementary cell comprising six square faces, each face defined by four nodes, which six faces are parallel in three pairs, with the planes containing each pair being perpendicular to the planes corresponding to the other two pairs, the three pairs including a pair of right and left faces, a pair of top and bottom faces, and a pair of front and back faces, wherein each elementary building block is formed by a process comprising:

providing a first zero-dimensional truncated octahedron elementary cell having no translational symmetry; and performing recursive reflection operations on the truncated octahedron elementary cell until each elementary building block comprising the three-dimensional eight-cell system has three translational symmetries and the lattice is formed.

22. A three-dimensional tensegrity lattice comprising at least eight truncated octahedron elementary cells, each truncated octahedron elementary cell comprising six square faces, each face defined by four nodes, which six faces are parallel in three pairs, with the planes containing each pair being perpendicular to the planes corresponding to the other two pairs, the three pairs including a pair of right and left faces, a pair of top and bottom faces, and a pair of front and back faces, the three-dimensional tensegrity lattice formed by a process comprising:

first reflecting a single truncated octahedron elementary cell about the plane containing the right face to form a two-cell system of truncated octahedron elementary cells;

second reflecting the two-cell system of truncated octahedron elementary cells about the plane containing the top face of each of the truncated octahedron elementary cells of the two-cell system to form a four-cell system of truncated octahedron elementary cells; and third reflecting the four-cell system of truncated octahedron elementary cells about the plane containing the front face of each of the truncated octahedron elementary cells of the four-cell system to form an eight-cell system of truncated octahedron elementary cells;

wherein a group of four contiguous truncated octahedron elementary cells have coincident nodes.

* * * * *